US008899635B2

(12) United States Patent
Nakanishi et al.

(10) Patent No.: US 8,899,635 B2
(45) Date of Patent: Dec. 2, 2014

(54) SLIDING DOOR MULTIPOINT MORTISE LOCK WITH SHOOT BOLTS

(75) Inventors: Yoshikazu Nakanishi, Tokyo (JP); Manabu Shimoji, Tokyo (JP); Douglas A. Nolte, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 1067 days.

(21) Appl. No.: 12/573,532

(22) Filed: Oct. 5, 2009

(65) Prior Publication Data

US 2010/0218568 A1 Sep. 2, 2010

Related U.S. Application Data

(60) Provisional application No. 61/102,697, filed on Oct. 3, 2008.

(51) Int. Cl.

| | |
|---|---|
| ***E05C 3/02*** | (2006.01) |
| ***E05C 9/00*** | (2006.01) |
| ***E05B 63/00*** | (2006.01) |
| ***E05B 65/08*** | (2006.01) |
| *E05C 9/18* | (2006.01) |
| *E05C 9/20* | (2006.01) |
| *E05C 9/04* | (2006.01) |

(52) U.S. Cl.

CPC ..... *E05B 65/0811* (2013.01); *E05C 9/004* (2013.01); *E05B 63/0056* (2013.01); *E05C 9/1858* (2013.01); *E05C 9/1875* (2013.01); *E05C 9/20* (2013.01); *E05C 9/041* (2013.01)

USPC ..... 292/194

(58) Field of Classification Search

CPC ..... E05B 13/002; E05C 3/24

USPC ..... 292/32–34, 37, 38, 40, 42, 44–47, 49, 292/50, 52, 54, 95, 96, 98–101, 194, 195, 292/197, 198, 200, 39, 51, DIG. 21, 292/DIG. 60; 70/108, 109, 110, 111, 120, 70/123, 137

See application file for complete search history.

(56) References Cited

U.S. PATENT DOCUMENTS

| | | | |
|---|---|---|---|
| 540,911 | A | 6/1895 | George |
| 614,144 | A | 11/1898 | Thompson |

(Continued)

FOREIGN PATENT DOCUMENTS

| | | | |
|---|---|---|---|
| DE | 1095709 | B | 12/1960 |
| DE | 2914377 | A1 | 10/1980 |

(Continued)

OTHER PUBLICATIONS

Rejuvenation, Large Brass Casement Window Fastener 8389, www.rejuvenation.com , Mar. 3, 2005, 1 Pg.

(Continued)

*Primary Examiner* — Kristina Fulton
*Assistant Examiner* — Nathan Cumar
(74) *Attorney, Agent, or Firm* — Patterson Thuente Pedersen, P.A.

(57) ABSTRACT

A multi-point lock assembly with shoot bolts adapted to fit a wide range of door heights with a limited number of standard components. The shoot bolts of the assembly can be trimmed to length and attached to other standard components to form the assembly.

8 Claims, 19 Drawing Sheets

(56) References Cited

U.S. PATENT DOCUMENTS 912,378 A 2/1909 Jackson
932,330 A 8/1909 Rotchford
958,880 A 5/1910 Lawson
1,023,766 A 4/1912 Sinclair
1,051,918 A 2/1913 Rowley
1,065,172 A 6/1913 Riggs
1,070,366 A 8/1913 Voight
1,078,549 A 11/1913 Northey
1,174,652 A 3/1916 Banks
1,216,765 A 2/1917 Anderson
1,320,444 A 11/1919 Bucznyski
1,334,314 A 1/1920 Parsons
1,385,102 A 7/1921 Winters et al.
1,402,964 A 1/1922 Robertson
1,515,611 A 11/1924 O'Connor
1,533,243 A 4/1925 Galterio
1,559,160 A * 10/1925 Carter ..... 70/114
1,585,689 A 5/1926 Piggot
2,033,079 A 3/1936 Lohrs
2,066,705 A 1/1937 Vazquez
2,159,315 A 5/1939 Blue
2,166,535 A 7/1939 Särenholm et al.
2,406,459 A 8/1946 Gibson
2,498,508 A 2/1950 Rudolph
2,701,157 A 2/1955 Le Bon, III
2,712,464 A 7/1955 Collar et al.
2,736,185 A 2/1956 Collar
2,823,941 A 2/1958 Ellis
2,855,234 A 10/1958 Eads
2,924,475 A 2/1960 Russell
2,943,514 A 7/1960 Golde
2,980,458 A 4/1961 Russell
3,041,097 A 6/1962 Eads
3,088,471 A * 5/1963 Fiore ..... 132/136
3,342,516 A 9/1967 Morand
3,400,562 A 9/1968 Bloss
3,543,441 A 12/1970 La Porte
3,586,360 A 6/1971 Perrotta
3,596,954 A 8/1971 Hull et al.
3,638,461 A * 2/1972 Watson ..... 70/92
3,666,306 A 5/1972 Genakis
3,949,525 A 4/1976 Bates et al.
3,953,061 A * 4/1976 Hansen et al. ..... 292/5
4,050,272 A 9/1977 Tanaka
4,068,874 A 1/1978 Fleming et al.
4,118,056 A 10/1978 Alexander
4,148,106 A 4/1979 Gallien
4,199,060 A * 4/1980 Howard ..... 206/231
4,253,688 A 3/1981 Hosooka
4,335,816 A 6/1982 Rager
4,389,061 A 6/1983 Foshee
4,434,635 A 3/1984 Borgato
4,476,700 A * 10/1984 King ..... 70/99
4,480,862 A 11/1984 Fleming
4,547,006 A 10/1985 Castanier
4,602,457 A 7/1986 Kreusel
4,639,021 A 1/1987 Hope
4,643,005 A * 2/1987 Logas ..... 70/95
4,676,537 A 6/1987 Esser
4,739,583 A 4/1988 Tönsmann et al.
4,803,808 A 2/1989 Greisner
4,932,691 A * 6/1990 White ..... 292/38
4,958,508 A 9/1990 Lin
4,962,653 A 10/1990 Kaup
4,973,091 A 11/1990 Paulson et al.
4,980,946 A 1/1991 Verasani et al.
4,988,133 A 1/1991 Shih
4,991,886 A 2/1991 Nolte et al.
5,045,265 A 9/1991 Pettit
5,058,938 A * 10/1991 Doring et al. ..... 292/45
5,078,200 A 1/1992 Guntermann et al.
5,087,087 A 2/1992 Vetter et al.
5,118,145 A 6/1992 Tucker
5,120,094 A 6/1992 Eaton et al.
5,183,310 A 2/1993 Shaughnessy
5,197,771 A * 3/1993 Kaup et al. ..... 292/45
5,245,846 A 9/1993 James
5,253,903 A 10/1993 Daley
5,290,077 A 3/1994 Fleming
5,301,525 A 4/1994 Döring
5,370,428 A 12/1994 Dreifert et al.
5,373,716 A 12/1994 MacNeil et al.
5,388,875 A 2/1995 Fleming
5,495,731 A 3/1996 Riznik
5,498,038 A 3/1996 Simon et al.
5,524,941 A 6/1996 Fleming
5,524,942 A 6/1996 Fleming
5,531,492 A 7/1996 Raskevicius
5,542,720 A 8/1996 Fleming
5,603,538 A 2/1997 Evers
5,620,216 A 4/1997 Fuller
5,642,909 A 7/1997 Swan et al.
5,660,420 A * 8/1997 Smith et al. ..... 292/3
5,722,704 A 3/1998 Chaput et al.
5,741,031 A 4/1998 Bauman et al.
5,752,727 A 5/1998 Zues et al.
5,778,602 A 7/1998 Johnson et al.
5,782,114 A 7/1998 Zeus
5,791,790 A 8/1998 Bender et al.
5,813,255 A 9/1998 Tell et al.
5,820,170 A 10/1998 Clancy
5,820,177 A 10/1998 Moon
5,839,767 A 11/1998 Piltingsrud
5,878,605 A 3/1999 Renz
5,878,606 A 3/1999 Chaput et al.
5,896,763 A 4/1999 Dinkelborg et al.
5,901,989 A 5/1999 Becken et al.
5,906,403 A 5/1999 Bestler et al.
5,927,767 A 7/1999 Smith et al.
5,951,068 A 9/1999 Strong et al.
6,006,560 A 12/1999 DeVries
6,045,169 A 4/2000 Frolov
6,135,511 A 10/2000 Smith et al.
6,161,881 A 12/2000 Babka et al.
6,209,931 B1 4/2001 Von Stoutenborough et al.
6,217,087 B1 4/2001 Fuller
6,266,981 B1 7/2001 Von Resch et al.
6,282,929 B1 9/2001 Eller et al.
6,324,876 B1 12/2001 Prevot et al.
6,327,881 B1 12/2001 Grundler et al.
6,349,982 B2 2/2002 Fayngersh et al.
6,354,121 B1 3/2002 Frolov
6,367,853 B1 4/2002 Briggs
6,389,855 B2 5/2002 Renz et al.
6,393,878 B1 5/2002 Fayngersh et al.
6,557,909 B2 5/2003 Morris
6,651,389 B2 11/2003 Minter et al.
6,651,466 B1 11/2003 Shih
6,682,109 B2 1/2004 Horne et al.
6,688,656 B1 2/2004 Becken
6,837,004 B2 1/2005 Annes
6,871,451 B2 3/2005 Harger et al.
6,871,884 B2 3/2005 Hoffmann et al.
6,962,377 B2 11/2005 Tönges
6,971,686 B2 * 12/2005 Becken ..... 292/39
7,003,990 B2 2/2006 Iliuk
7,004,515 B2 2/2006 Timothy
7,025,394 B1 4/2006 Hunt
7,108,300 B2 9/2006 Hodgin et al.
7,178,839 B2 2/2007 Tsai
7,303,215 B2 12/2007 Moon et al.
7,510,222 B2 3/2009 Hodgin et al.
7,752,875 B2 7/2010 Constantinou et al.
2004/0145189 A1 7/2004 Liu
2006/0087125 A1 4/2006 Moon et al.
2006/0091679 A1 5/2006 Tsai
2007/0096476 A1 5/2007 Vetter

FOREIGN PATENT DOCUMENTS

DE 10255733 A1 6/2004
EP 117744 9/1984
EP 0431369 A2 6/1991
EP 0327264 B1 12/1992

(56) References Cited

FOREIGN PATENT DOCUMENTS

| | | | | |
|---|---|---|---|---|
| FR | 2435586 | | | 4/1980 |
| GB | 2212849 | | | 8/1989 |
| GB | 2281097 | A | | 2/1995 |
| GB | 2337556 | A | | 11/1999 |
| JE | EP 0943767 | | * | 11/1999 |
| JP | 6010553 | | * | 1/1994 |
| JP | 6010553 | A | * | 1/1994 |

OTHER PUBLICATIONS

Ferco Corp., Fittings for tilt-turn gears JET AS 130 Aluminium joinery, 1991, 12 Pgs.

Truth Hardware, Multi-Point Locking System, *Truth Hardware Catalog*, 1993, 8 Pgs., pp. 2.7-2.7g.

Truth Hardware, Engineering Drawing No. 31868, Nov. 3, 1996, 1 Pg.

Truth Hardware, Mirage™ Concealed Multi-Point Locking System (Tie Bar in Jamb version), *Truth Hardware Catalog*, 1996, 12 pgs., pp. 2.5-2.5k.

PCT Search Report cited in PCT Application No. PCT/US2008/006489, dated Nov. 18, 2008, 2 Pgs.

U.S. Appl. No. 12/124,823, filed May 21, 2008.

Canadian Office Action for Canadian Application No. 2,681,067 dated Nov. 19, 2013.

* cited by examiner 100
104
108
108a
108b
1c
1e
82
92
96
88
84
94
97
98
99
78
87

STROKE 2 X C
STROKE C

SLIDING DOOR MULTIPOINT MORTISE LOCK WITH SHOOT BOLTS

RELATED APPLICATIONS

This application claims the benefit of U.S. Provisional Patent Application No. 61/102,697, entitled SLIDING DOOR MULTIPOINT MORTISE LOCK WITH SHOOT BOLTS, filed Oct. 3, 2008, hereby fully incorporated herein by reference.

FIELD OF THE INVENTION

This invention relates to lock mechanisms for sliding doors. More particularly, a multi-point lock of the present disclosure provides for combinations of mortise lock(s) and shoot bolt(s) that can be easily adjusted to fit various door heights.

BACKGROUND OF THE INVENTION

In a typical sliding door installation, such as often found in the case of patio doors, the door is latched by a mechanism mounted in the locked face of the stile of a sliding door. In a single-point latch mechanism, a single hook, or other latching component engages a receiving (keeper) component disposed in the door jamb to latch the door and maintains the door in a latched state. While single-point latch mechanisms often provide satisfactory performance, the use of a single hook often fails to provide the security desired by a homeowner.

In response to the desire for increased security by homeowners, a variety of multi-point latches have been developed for use in sliding door installations. These multi-point mechanisms can be mounted in the locked face of the stile of the sliding door with multiple latching elements engaging a receiving structure mounted on a door jamb. These multi-point latches increase the security of the latch mechanisms by providing additional locking strength, thereby diminishing the likelihood of forced entry.

Another response to the desire for increased security by homeowners is to provide sliding doors with shoot bolts as the locking mechanism. While a latch mechanism that is mounted in the locked face of a sliding door can be used with a sliding door of any height, a shoot bolt mechanism must be adapted for use with a particular door height, as the respective face plates must be flush with the top and bottom surfaces of the sliding door. Accordingly, prior art shoot bolt solutions have typically involved a multiplicity of shoot bolts and lock assemblies of different fixed lengths that must be mixed and matched to fit doors of different standard heights. Further, non-standard door heights typically cannot be accommodated with such prior shoot bolt systems without resorting to custom made components.

Accordingly, there is still a need in the industry for a multi-point door latch assembly with shoot bolts that is simple to install and operate, easily adapted to a wide range of door heights with a limited number of standard components, and is designed to provide increased security against forced entry.

SUMMARY OF THE INVENTION

This invention substantially meets the aforementioned needs of the industry by providing a multi-point door latch assembly with shoot bolts, that is simple to install and operate, easily adapted to a wide range of door heights, and is designed to provide increased security against forced entry. In an embodiment, the lock assembly is adapted to be installed in the moving panel of a sliding patio door. The lock assembly of this invention may have one or more locking points with additional locking points in separate modules.

In an embodiment, the lock assembly is equipped with two hook assemblies. In other embodiments, the lock assembly may be equipped with more than two hook assemblies. In embodiments where the drive bar assembly is equipped with two or more hook assemblies, at least two of the hooks may rotate into opposing locked positions.

A shoot bolt assembly according to an embodiment may include a drive assembly, that is mounted within a housing, and that is functionally coupled to a drive bar and a locking bolt. A face plate encloses these elements within the housing. The drive assembly may include one or more pinions, a fixed rack, and a driven rack. Linear movement of the drive bar causes the pinions to roll along the fixed rack, thereby driving the driven rack and connected bolt to extend and retract the bolt from the housing. A one unit linear movement of the drive bar may result in two units of linear travel of the bolt.

The shoot bolt assembly drive bar and face plate can be cut to enable an installation of the present invention to fit a range of door heights. Such a cut can be accomplished by positioning the locking bolt in the fully extended (locking) position, ensuring that the ends of the face plate and driver bar are registered, and then cutting the face plate and driver bar in one pass, eliminating any need to cut the face plate and driver bar separately.

The arrangement of the shoot bolt assembly components enables installation of the lock assembly to fit a range of door heights via the use of extension bar assemblies and by cutting the shoot bolt assemblies to a length appropriate for each installation. As will be immediately recognized by those skilled in the art, the use of an extension bar assembly or assemblies within a lock assembly further increases the range of door heights that can be accommodated.

The lock assembly of this invention is self-contained, but may be fitted with a variety of optional components, such as door handles, exterior pulls, and locks. Moreover, two or more of the described subassemblies can be simply and inexpensively integrated into a single assembled unit, which can also include one or more of the foregoing additional components.

According to an embodiment, a multi-point lock assembly adapted for accommodating a plurality of door panel height dimensions includes an active lock actuator assembly, a passive lock assembly operably coupled to the active lock actuator assembly, and a shoot bolt assembly operably coupled to the passive lock assembly, wherein a length dimension of the shoot bolt assembly is alterable to accommodate each of the plurality of door panel height dimensions. The multi-point lock assembly may further include a linking adaptor assembly interposed between the passive lock assembly and the shoot bolt assembly. The linking adaptor assembly may include a drive bar with a connector with the shoot bolt assembly including a drive bar having a proximal end with a serrated portion. The connector of the linking adaptor assembly engages with the serrated portion of the shoot bolt assembly drive bar.

In further embodiments, the shoot bolt assembly includes a face plate, a drive bar slidably disposed on the face plate, and a bolt assembly slidably disposed on the face plate and operably coupled with the drive bar. The shoot bolt assembly may also include a gear drive assembly operably coupling the drive bar and the bolt assembly. The gear drive assembly may include a fixed rack, a driven rack, and at least one pinion engaged with the fixed rack and the driven rack. The shoot bolt assembly may further include a housing fixed to the face plate, with the fixed rack fixedly attached to the housing or the face plate. The pinion may be carried on the drive bar of the shoot bolt assembly, and the drive rack carried on the bolt assembly. The multi-point lock assembly may further include an extension bar assembly interposed between and operably coupling the passive lock actuator assembly and the shoot bolt assembly.

In other embodiments, a method of installing a multi-point lock assembly in a door panel includes disposing an active lock actuator assembly and a passive lock actuator assembly in a mortise defined in an edge of the door panel, the active lock actuator assembly operably coupled with the passive lock actuator assembly, trimming a length of a shoot bolt assembly, and operably coupling the trimmed shoot bolt assembly with the passive lock actuator assembly and disposing the shoot bolt assembly in the mortise. Trimming the length of the shoot bolt assembly may include registering an end of a drive bar of the shoot bolt assembly with an end of a face plate of the shoot bolt assembly, and cutting the drive bar of the shoot bolt assembly and the face plate of the shoot bolt assembly together at the same location. The method may also include interposing an extension bar assembly between the passive lock assembly and the shoot bolt assembly and operably coupling the extension bar assembly with the passive lock assembly and the shoot bolt assembly. The method may further include interposing a linking adaptor between the passive lock assembly and the shoot bolt assembly, and operably coupling the linking adaptor with the passive lock assembly and the shoot bolt assembly.

In further embodiments, a multi-point lock assembly component kit for a door panel includes an active lock actuator assembly, a passive lock assembly adapted to operably couple to the active lock actuator assembly, a shoot bolt assembly adapted to operably couple to the passive lock assembly, wherein a length dimension of the shoot bolt assembly is alterable by trimming off a portion of the shoot bolt assembly, and instructions for trimming the shoot bolt assembly to accommodate each of a plurality of door panel height dimensions. The instructions may be in written form or may be provided in any other form, such as on computer readable media, video media, or sound media. The instructions may be provided with a kit or separate from the kit.

In further embodiments, the kit may include a linking adaptor assembly adapted to operably link the passive lock assembly and the shoot bolt assembly. The linking adaptor assembly may include a drive bar with a connector, the shoot bolt assembly may include a drive bar having a proximal end with a serrated portion, and the connector of the linking adaptor assembly may be adapted to engage with the serrated portion of the shoot bolt assembly drive bar. The shoot bolt assembly may include a face plate, a drive bar slidably disposed on the face plate, and a bolt assembly slidably disposed on the face plate and operably coupled with the drive bar. The shoot bolt assembly may further include a gear drive assembly operably coupling the drive bar and the bolt assembly. The gear drive assembly may include a fixed rack, a driven rack, and at least one pinion engaged with the fixed rack and the driven rack. The at least one pinion may be carried on the drive bar of the shoot bolt assembly, and the driven rack may be carried on the bolt assembly.

Throughout the specification, any references to such relative terms as top and bottom, and the like, are intended for convenience of description and are not intended to limit the present invention or its components to any one positional or spatial orientation. It will be further understood that various dimensions of the components in the attached figures may vary depending upon specific applications and intended use of the invention without departing from the scope of the invention.

These and other objects, features, and advantages of various embodiments will become apparent from the description which follows, when considered in view of the accompanying drawings.

BRIEF DESCRIPTION OF THE DRAWINGS

The invention may be more completely understood in consideration of the following detailed description of various embodiments of the invention in connection with the accompanying drawings, in which.

Figure 1:
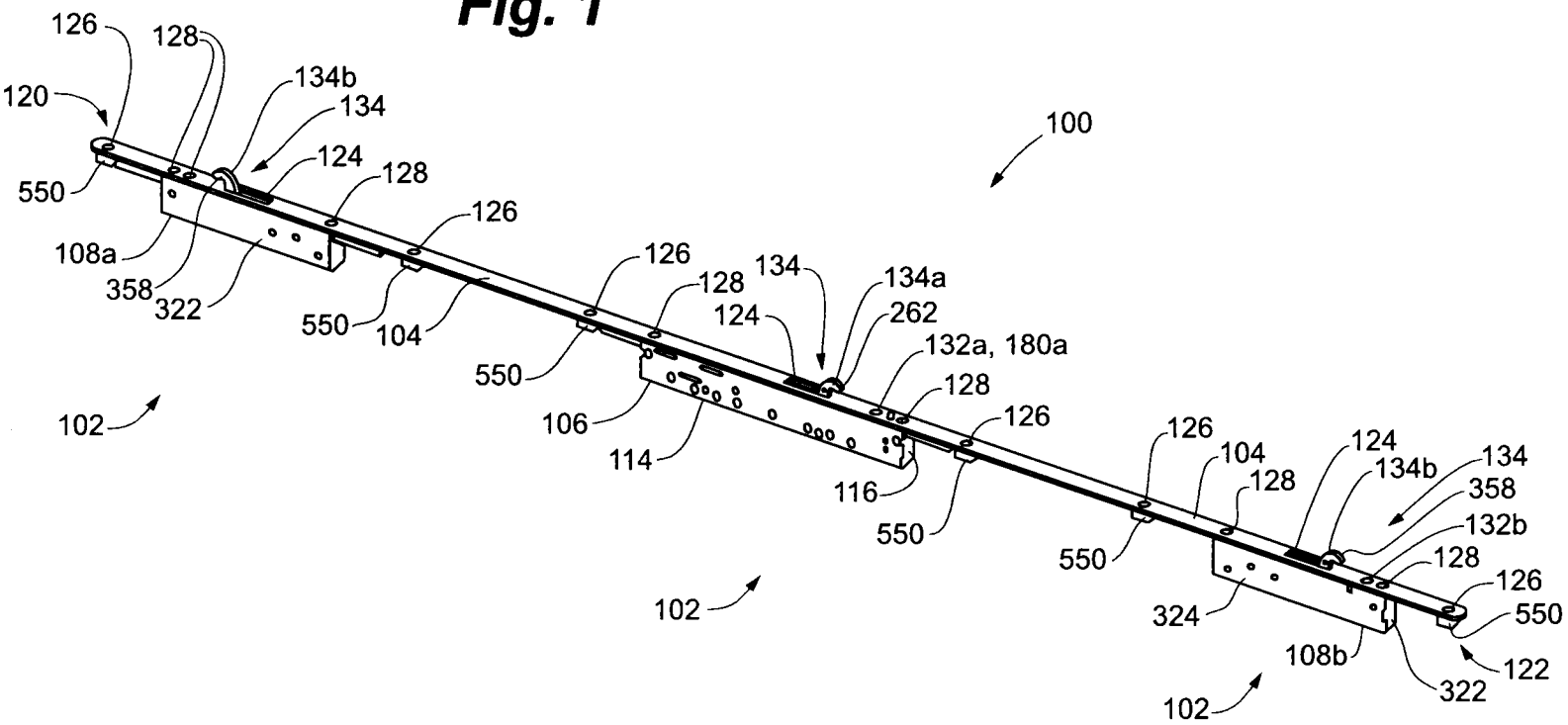
FIG. 1 is a perspective view depicting a multipoint sliding door lock assembly for use with shoot bolts.

While the present invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

As depicted in FIGS. 1, and 1*b*-1*e*, a multipoint sliding door lock assembly 100 for use with shoot bolt assemblies 30, generally includes lock assemblies 102, faceplate 104, linking members 110, and linking adapters 80. The components of multipoint sliding door lock 100 can be fabricated from suitable materials of construction, including, for example, carbon steel, stainless, aluminum, nylon, and combinations thereof.

Shoot bolt assembly 30 is depicted in FIGS. 2*a* through 2*g* and 3*a*-3*b*. Shoot bolt assembly 30 generally includes face plate 32, housing 34, drive bar 36, bolt assembly 38, and gear drive assembly 40. Housing 34 is secured to face plate 32 with rivets 42, and defines an enclosure for receiving gear drive assembly 40.

Drive bar 36 is slidably disposed on inner surface 44 of face plate 32, and includes serrated portion 46 extending outward from housing 34. Bolt 38 is also slidably disposed on face plate 32 and generally includes a pair of outer fork plates 48 and one or more internal spacer plates 50 held together with rivets 52. Fork plates 48 extend into housing 34 on each side of rivet 42.

Gear drive assembly 40 generally includes fixed rack 54, driven rack 56, and pinions 58. Pinions 58 are rotatably coupled with and are carried on drive bar 36. Fixed rack 54 is fixedly coupled with housing 34, while driven rack 56 is coupled with bolt 38.

Figure 2:
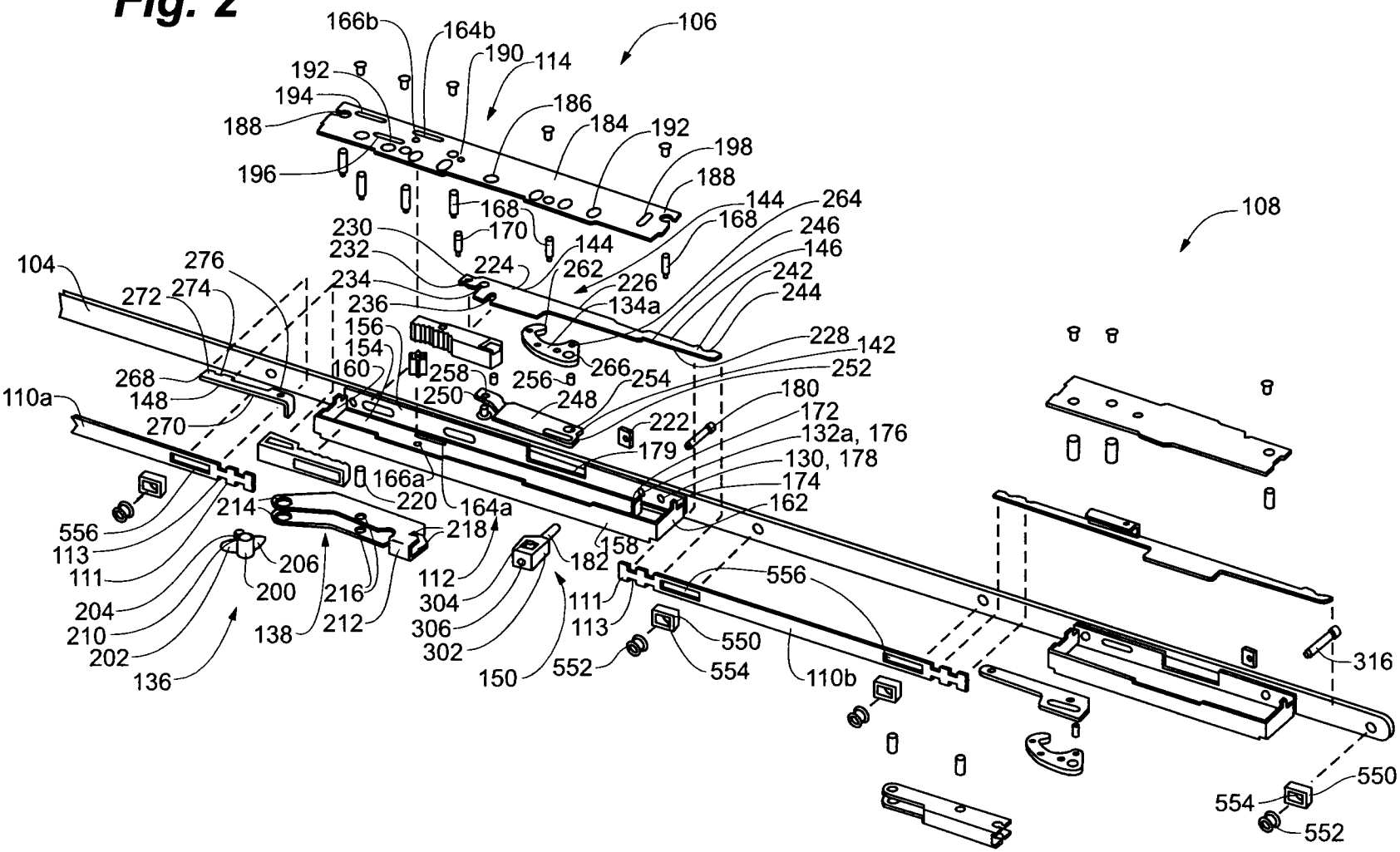
FIG. 2 is an exploded perspective view depicting an active locking device and a lower passive locking device for use with shoot bolts according to an embodiment.
Figures 2A, 2B, 2C, 2D, 2E, 2F, 2G, 2H, 2I:
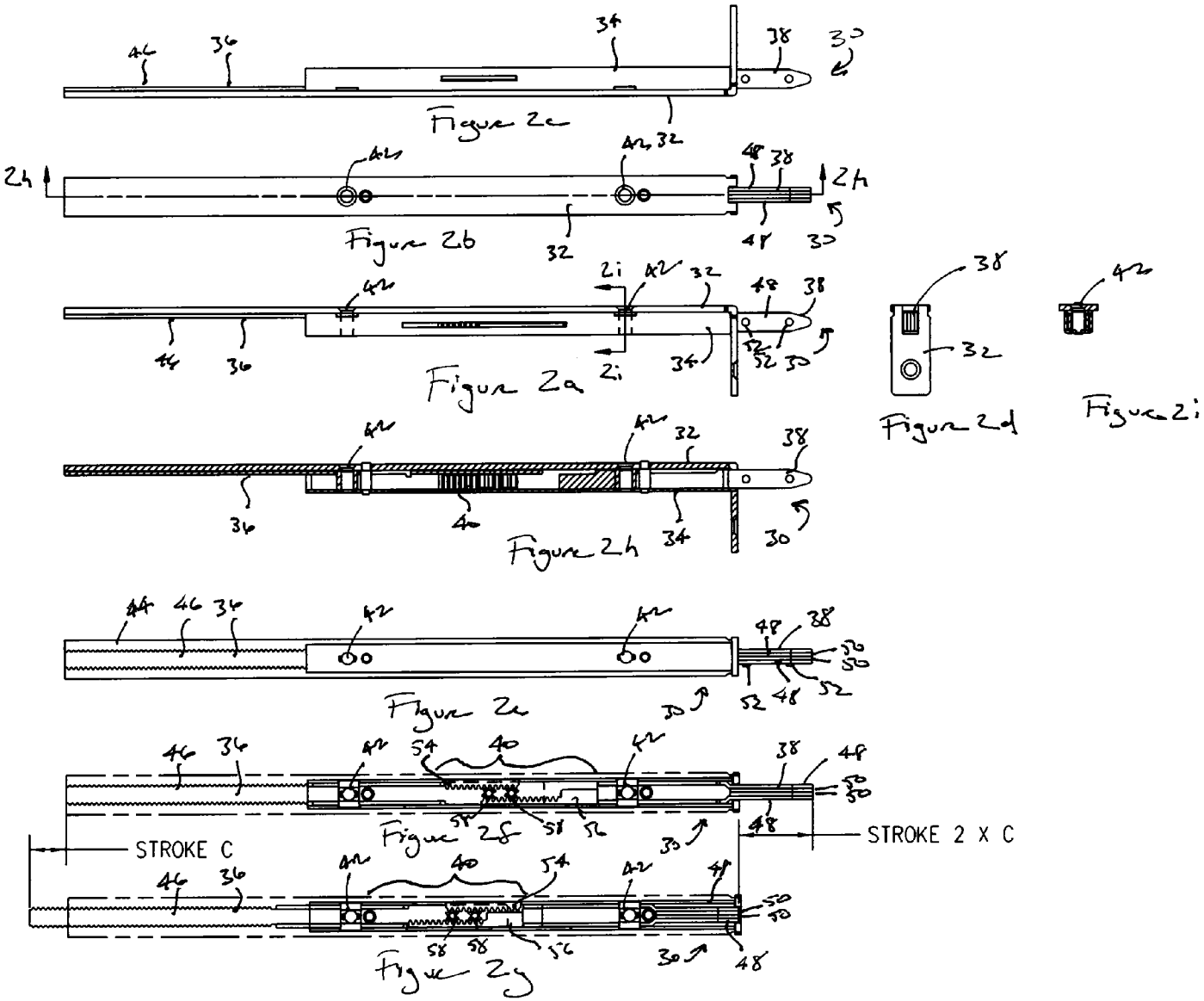
FIG. 2*a* is a side elevation view of a shoot bolt assembly according to an embodiment.
FIG. 2*b* is a front plan view of the shoot bolt assembly of FIG. 2*a;*
FIG. 2*c* is an opposite side elevation view of the shoot bolt assembly of FIG. 2*a;*
FIG. 2*d* is a top plan view of the shoot bolt assembly of FIG. 2*a;*
FIG. 2*e* is a rear plan view of the shoot bolt assembly of FIG. 2*a;*
FIG. 2*f* is a rear plan cutaway view of the shoot bolt assembly of FIG. 2*a* depicting the bolt in the extended position.
FIG. 2*g* is a rear plan cutaway view of the shoot bolt assembly of FIG. 2*a* depicting the bolt in the retracted position.
FIG. 2*h* is a cross-sectional view taken at section 2*h*-2*h* of FIG. 2*b;*
FIG. 2*i* is a cross-sectional view taken at section 2*i*-2*i* of FIG. 2*a;*

In use, a translating force may be applied to shift drive bar 36 longitudinally along face plate 32. As drive bar 36 is shifted into housing 34, pinions 58 roll along fixed rack 54, and cause driven rack 56 and bolt 38 to shift in the same direction, thereby extending bolt 38 outward from housing 34. In a preferred embodiment, as depicted in FIGS. 2*f* and 2*g*, it will be appreciated that for a given stroke distance C of drive bar 36, bolt 38 will be shifted outward twice stroke distance C (2C). Of course it will also be appreciated that other stroke distance ratios can be achieved by varying the geometry and configuration of gear drive assembly 40, and that such other configurations and geometries are contemplated within the scope of the present invention.

Figure 4:
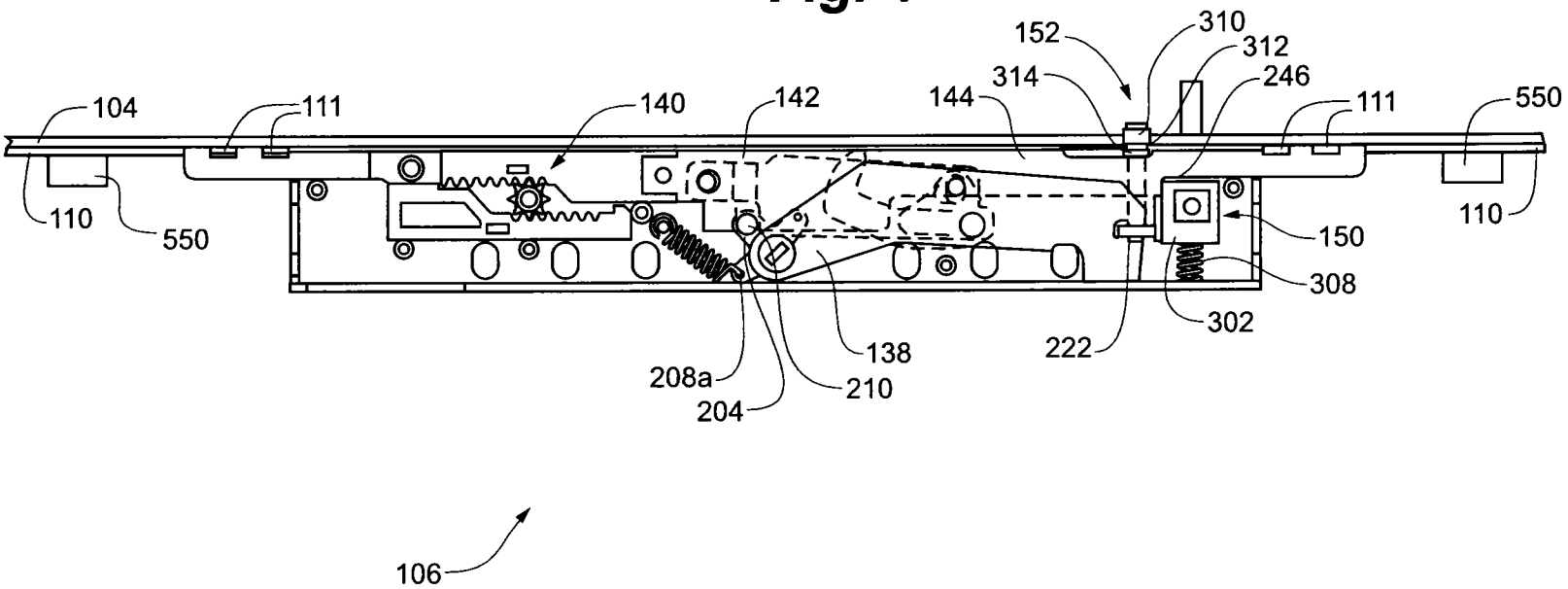
FIG. 4 is cross-sectional view depicting an active locking device for use with shoot bolts according to an embodiment, depicted in an unlocked position.
Figure 4B:
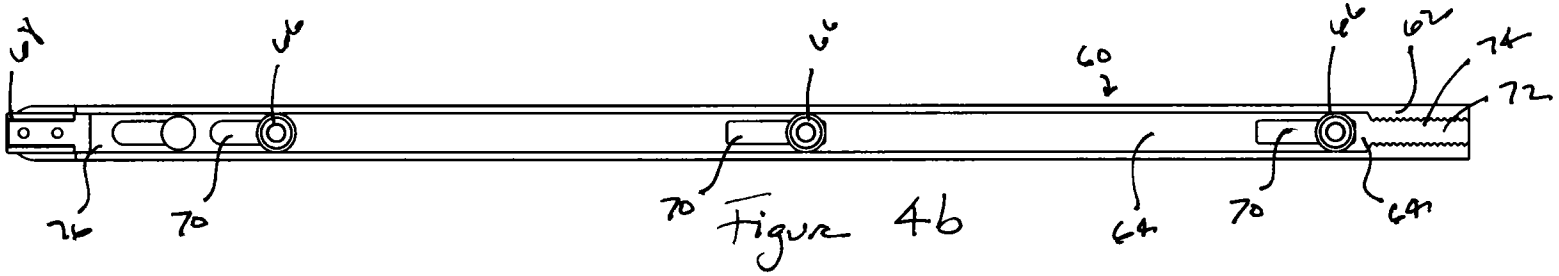
FIG. 4*b* is a front plan view of the extension bar assembly of FIG. 4*a;*
Figure 4A:
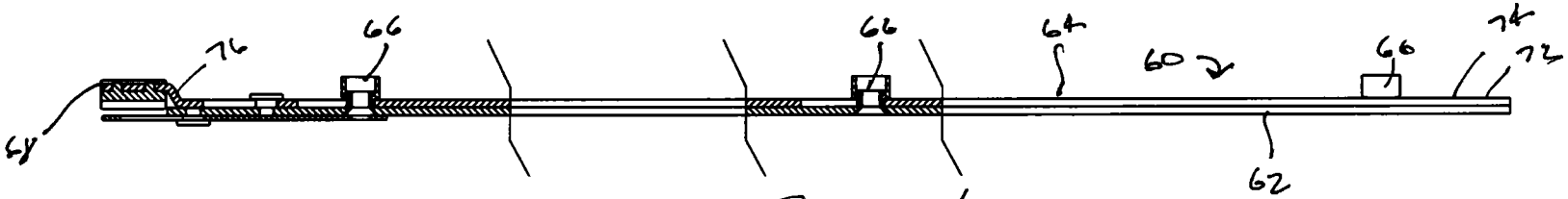
FIG. 4*a* is a side elevation view of an extension bar assembly according to an embodiment of the invention.
Figure 4C:
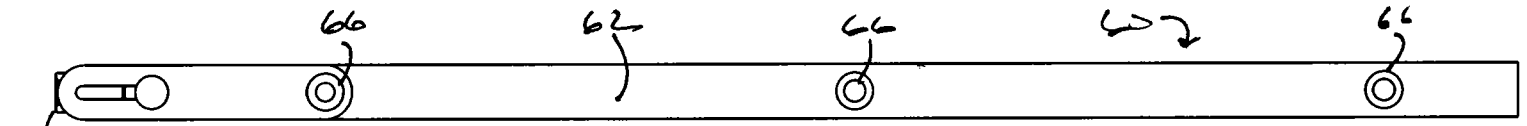
FIG. 4*c* is a rear plan view of the extension bar assembly of FIG. 4*a;*

An extension bar assembly 60 according to embodiments of the invention is depicted in FIGS. 4*a*-4*c*. Extension bar assembly 60 generally includes faceplate 62, drive bar 64, fasteners 66, and coupler 68. Drive bar 64 is slidably disposed on faceplate 62 and defines elongate slots 70. Further, serrated coupling portion 72 is defined at proximal end 74 of drive bar 64, while coupler 68 is attached at distal end 76.

In use, a translating force may be applied to proximal end 74 to shift drive bar 64 longitudinally along faceplate 62. As drive bar 64 shifts, coupler 68 is shifted a corresponding distance in the same direction.

It will be appreciated that extension bar assembly 60 may be made in a variety of pre-determined lengths to accommodate various door heights and combinations of components as will be further described hereinbelow.

Figure 1A:
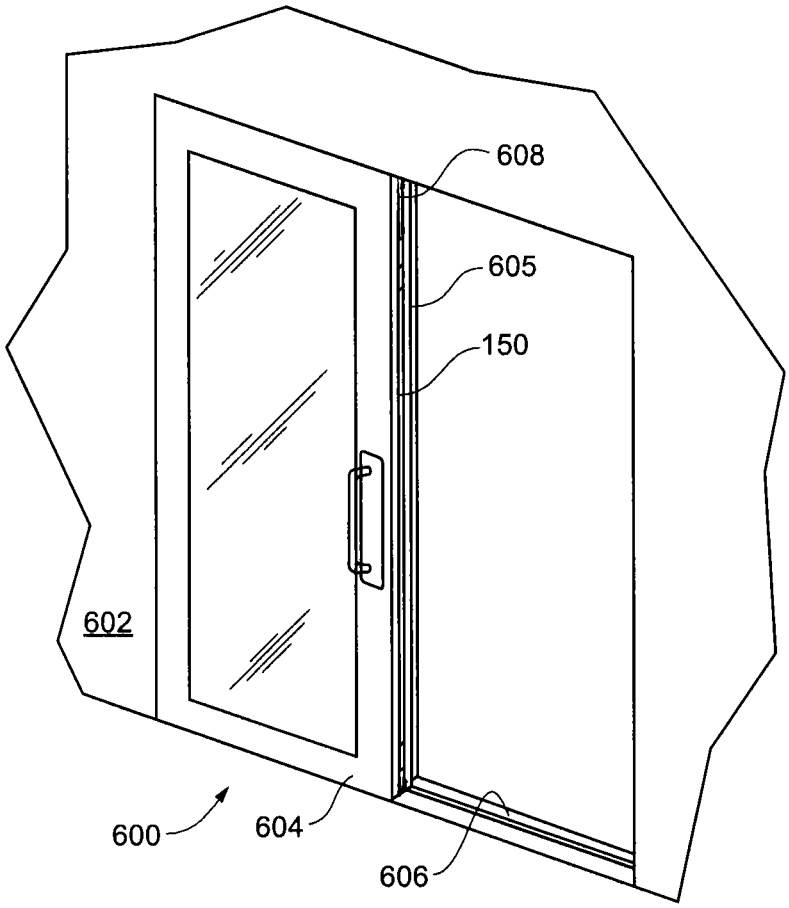
FIG. 1*a* is a perspective view of a sliding door assembly according to an embodiment.
Figures 1B, 1C, 1D, 1E:
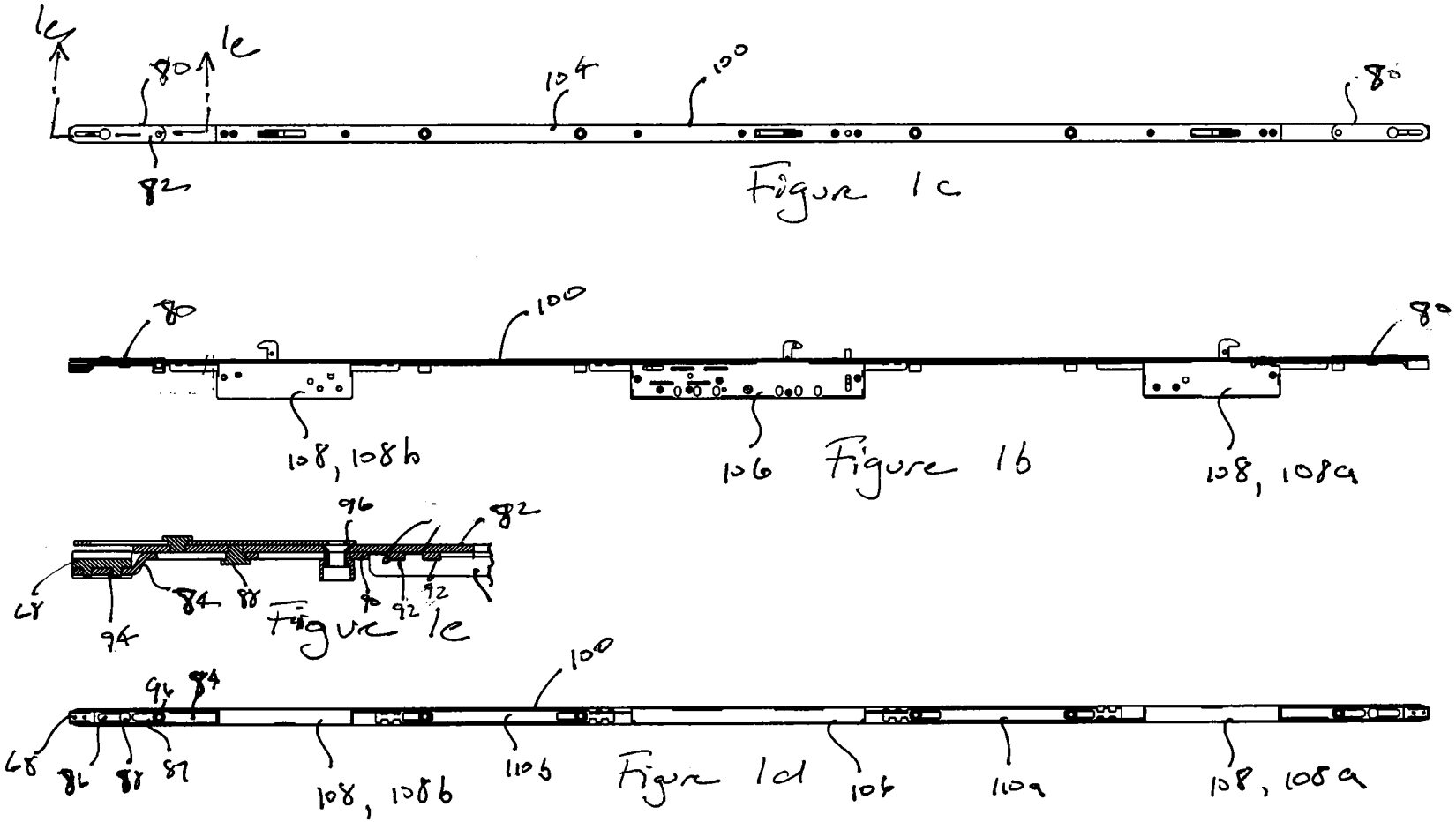
FIG. 1*b* is a side elevation view of a multipoint sliding door lock assembly with linking adaptors according to an embodiment.
FIG. 1*c* is a front plan view of the multipoint sliding door lock assembly of FIG. 1*b;*
FIG. 1*d* is a rear plan view of the multipoint sliding door lock assembly of FIG. 1*b;*
FIG. 1*e* is a cross sectional view taken at section 1*e*-1*e* of FIG. 1*b;*

As depicted in FIG. 1*e*, linking adapter 80 generally includes faceplate 82 and drive bar 84. Drive bar 84 is slidably disposed on faceplate 82 and defines slots 86, 87. Rivet 88 extends through slot 86 to secure drive bar 84 to faceplate 82. Proximal end 90 of drive bar 84 defines projections 92, while coupler 68 is fastened at distal end 94. Fastener 96 extends through slot 87 to attach linking adapter 80 to lock assembly 100.

In use, a translating force may be applied to proximal end 90 to shift drive bar 84 longitudinally along faceplate 82. As drive bar 84 shifts, coupler 68 is shifted a corresponding distance in the same direction.

Although the structure and use of lock assembly 100, is known though previous PCT Publication No. WO 2008/153707 A2, owned by the owners of the present invention, said application being hereby fully incorporated herein by reference, lock assembly 100 will be described herein to facilitate understanding of the present invention. Lock assembly 100 generally includes active locking device 106 and passive locking devices 108. Passive locking devices 108 include upper passive locking device 108*a* and lower passive locking device 108*b*. Linking members 110 have teeth 111 and grooves 113. Active locking device 106 and upper passive locking device 108*a* are operably coupled by upper linking member 110*a*. Active locking device 106 and lower passive locking device 108*b* are operably coupled by lower linking member 110*b*. Upper passive locking device 108*a* and lower passive locking device 108*b* are substantially similar passive locking devices 108 apart from their orientation on faceplate 104 in relation to active locking devices 106.

The terms "upper" and "lower" used to describe passive locking devices 108 generally refer to positions in relation to a sliding door (not shown) on which multipoint sliding door lock 100 may be mounted. Upper passive locking device 108*a* is positioned more proximate the top of the door, while lower passive locking device 108*b* is positioned more proximate the bottom of the door. The positions of upper passive locking device 108*a* and lower passive locking device 108*b* on a sliding door can also be switched without departing from the spirit or scope of the present invention.

Each lock assembly 102 generally comprises a discrete housing for enclosing, mounting, and protecting the functions performed by lock assembly 102. Active locking device 106 includes active locking-device base 112 secured to active locking-device cover 114. Upper passive locking device 108*a* includes passive locking-device base 116 secured to passive locking-device cover 118. Lower passive locking device 108*b* including passive locking-device base 116 secured to passive locking-device cover 118.

Faceplate 104 generally has top end 120, bottom end 122, latch channels 124, mounting holes 126, attachment holes 128, anti-slam actuator hole 130, and large depth-adjustment screw hole 132. Adjustable latches 134 can move within and through lock channels 124. Faceplate 104 can be mounted to a sliding door by way of suitable fasteners positioned within mounting holes 126. Suitable fasteners for this purpose can include screws, bolts, rivets, nails, adhesives, combinations thereof, and the like. As an optional feature, mounting holes 126 can provide for fasteners to be countersunk for greater aesthetic appeal and safety.

As depicted in FIGS. 1-6, active locking device 106 generally includes active locking-device base 112, active locking-device cover 114, active latch 134*a*, crank member 136, active-lock positioner 138, gear-drive system 140, active-lock drive plate 142, active-lock actuator 144 defining lower linking-member engager 146, upper linking member-engager 148, anti-slam mechanism 150, depth-adjustment mechanism 152, and several connecting pins.

As depicted in FIGS. 2-6 and 10-11, active locking-device base 112 generally includes main wall 154, front wall 156, back wall 158, top wall 160, and bottom wall 162. Main wall 154 has several slots, including back-gear protrusion slot (not shown), back-gear guide slot (not shown), spring post hole (not shown), and front-gear guide slot 164*a*. Main wall 154 also has crank-member hole (not shown), handle-fastener holes (not shown) and cog-protrusion hole 166*a*. Extending from main wall 154 toward active locking-device cover 114 are fastening posts 168, spring post 170, and anti-slam brace 172. Fastening posts 168 and spring post 170 are attached to main wall 154 using a suitable connection method, including, for example, welding, press-fit, and spin-fit techniques. Anti-slam brace 172 can be formed by bending toward active locking-device cover 114 a portion of main wall 112. Front wall 156 has attachment holes 174, small depth-adjustment screw hole 176, anti-slam protrusion hole 178 and active-latch opening 179. Attachment holes 174 of main wall 154 are generally aligned with attachment holes 128 of faceplate 104 so that fastening members are inserted through aligned attachment holes 128,174, to secure active locking-device base 112 to faceplate 104. Small depth-adjustment screw hole 176 of main wall 154 and large depth-adjustment screw hole 132*a* of faceplate 104 are generally aligned so as to receive depth adjustment screw 180*a*. Anti-slam protrusion hole 178 of front wall 156 is generally aligned with anti-slam actuator hole 130 of faceplate 104 so as to receive anti-slam actuator 182. In addition, active-latch opening 179 in front wall 156 of active locking-device base 112 is generally aligned with latch channel 124 of faceplate 104 so as to allow active latch 134*a* to freely pivot between locked and unlocked positions.

Active locking-device cover 114 generally includes cover plate 184 with a plurality of apertures and slots. The apertures includes crank-member hole 186, cover-screw holes 188, spring-post hole 190, handle-fastener holes 192, and cog-protrusion hole 166*b*. The slots include back-gear protrusion slot 194, back-gear guide slot 196, front-gear guide slot 164*b*, and anti-slam protrusion slot 198. Cover plate 184 has a shape so as to conformingly fit over front wall 156, back wall 158, top wall 160, and bottom wall 162 of active locking-device base 112. Generally, crank-member hole 186 is aligned with crank member 136, and cover-screw holes 188 are aligned with fastening posts 168, cog-protrusion hole 166*a* of active locking-device cover 114 is aligned with cog-protrusion hole 166*b* of active-locking device base 112 so as to allow active latch 134*a* to freely pivot between locked and unlocked positions. In addition, handle-fastener holes 192, back-gear protrusion slot 194, back-gear guide slot 196, and front-gear guide slot 164*b* of active locking-device cover 114 are generally aligned with handle-fastener holes (not shown), back-gear protrusion slot (not shown), back-gear guide slot (not shown), and front-gear guide slot 164*a* of active locking-device base 112 so as to allow active latch 134*a* to freely pivot between locked and unlocked positions.

Crank member 136 generally includes crank body 200, top crank arm 202, middle crank arm 204, and bottom crank arm 206. Crank body 200 generally defines actuator-pin slot 206 and crank-arm protrusion 210. Top crank arm 202 and bottom crank arm 206 generally define spring holes 208*a,b*. Middle crank arm 204 generally defines crank-arm protrusion 210.

Active-lock positioner 138 generally includes positioner housing 212 generally defining crank holes 214, small pivot-pin holes 216, and adjustment-bolt recesses 218. Crank holes 214 rotatably receive crank member 136. Small pivot-pin holes 216 can fixedly receive pivot pin 220. Adjustment-bolt recess 218 can rotatably receive threaded depth-adjustment bolt 222.

Active-lock actuator 144 generally includes upper engagement region 224, middle region 226, and lower engagement region 228. Upper engagement region 224 generally defines actuator extension 230 defining front-gear protrusion hole 232, small actuator-pin hole 234, and crank-protrusion recess 236. Middle region 226 generally defines lock-channel cover 238. Lower engagement region 228 generally defines lower linking member engager 146 defining teeth 242 and grooves 244. The interface between middle region 226 and lower engagement region 228 defines anti-slam recess 246.

Active-lock drive plate 142 generally includes drive-plate body 248 and drive-plate head 250. Drive-plate body 248 and drive-plate head 250 can occupy different planes. Drive plate body 248 generally defines pivot-pin slot 252 and drive-pin slot 254. Pivot-pin slot 252 can transversely receive pivot pin 220 along a lateral axis. Drive-pin slot 254 can transversely receive drive pin 256 along longitudinal and lateral axes. Drive-plate head 250 generally defines large actuator-pin hole 258. Large actuator-pin hole 258 can rotatably receive actuator rivet 260.

Active latch 134*a* generally includes hook 262, drive-pin hole 264, and large pivot-pin hole 266. Hook 262 is generally shaped so to engage a keeper (not shown) when active latch 134*a* is in a locked position. Drive-pin hole 264 can receive drive pin 256. Large pivot-pin hole 266 can rotatably receive pivot pin 220.

Upper-linking member engager 148 generally includes an upper region 268 and a lower region 270. Upper region generally defines teeth 272 and grooves 274. Lower region 270 generally defines back-gear protrusion hole 276. Lower region 270 is bent toward main wall 154 of active locking-device base 112 to further secure upper linking member engager 148 within active locking device 106.

Gear-drive system 140 generally includes cog 278, front gear drive 280, back gear drive 282. Cog 278 generally defines cog protrusions 284 and gears 286. Cog-protrusion holes 166*a-b* of main wall 154 and cover plate 184 receive cog-protrusions 284. Front gear-drive 280 generally includes gears 288, front-gear guides 290, front-gear recess 292, and front-gear protrusion 294. Gears 288 of front-gear drive 280 engage gears 286 of cog 278. Front-gear guide slots 164*a-b* transversely receives front-gear guides 290 so as to allow active latch 134*a* to freely pivot between locked and unlocked positions. Front-gear recess 292 can receive actuator extension 230 so that front-gear protrusion hole 232 receives front-gear protrusion 294. Back gear drive 282 generally includes gears 296, back-gear guides 298, and back-gear protrusion 300. Gears 286 of cog 278 engage gears 296 of back-gear drive 282. Back-gear guide slots 196 transversely receive back-gear guides 298 so as to enable active latch 134*a* to freely pivot between locked and unlocked positions. Back-gear protrusion hole 276 of upper linking member engager 270 receives back-gear protrusion 300.

Figure 5:
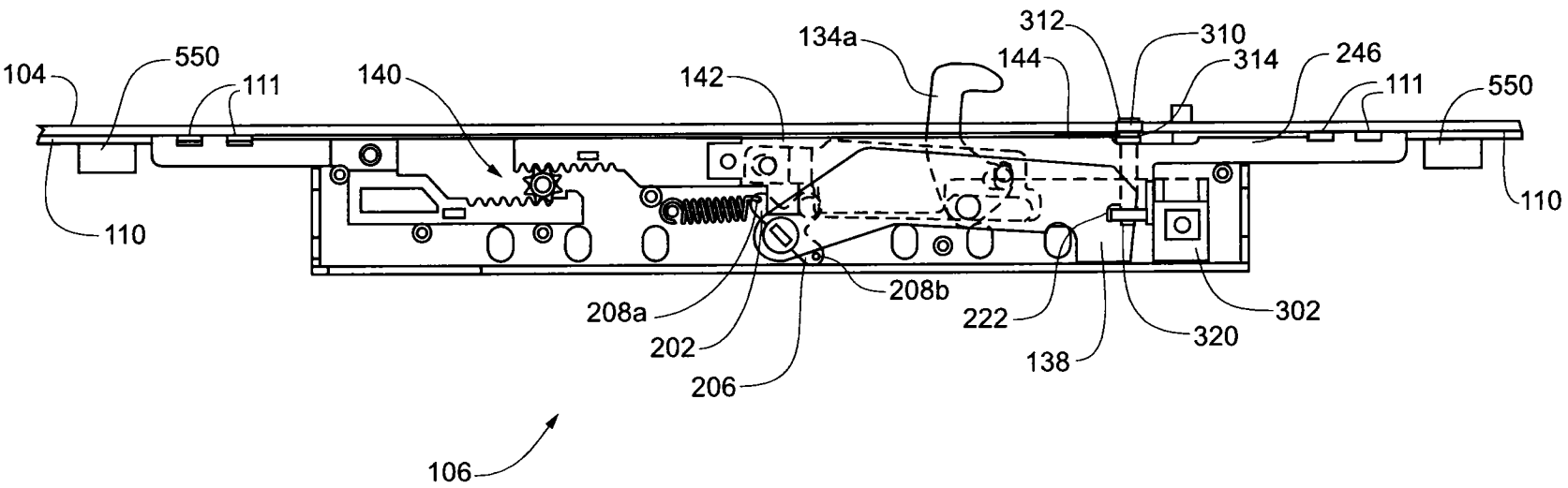
FIG. 5 is a cross-sectional view depicting an active locking device for use with shoot bolts according to an embodiment, depicted in a locked position.
Figure 6:
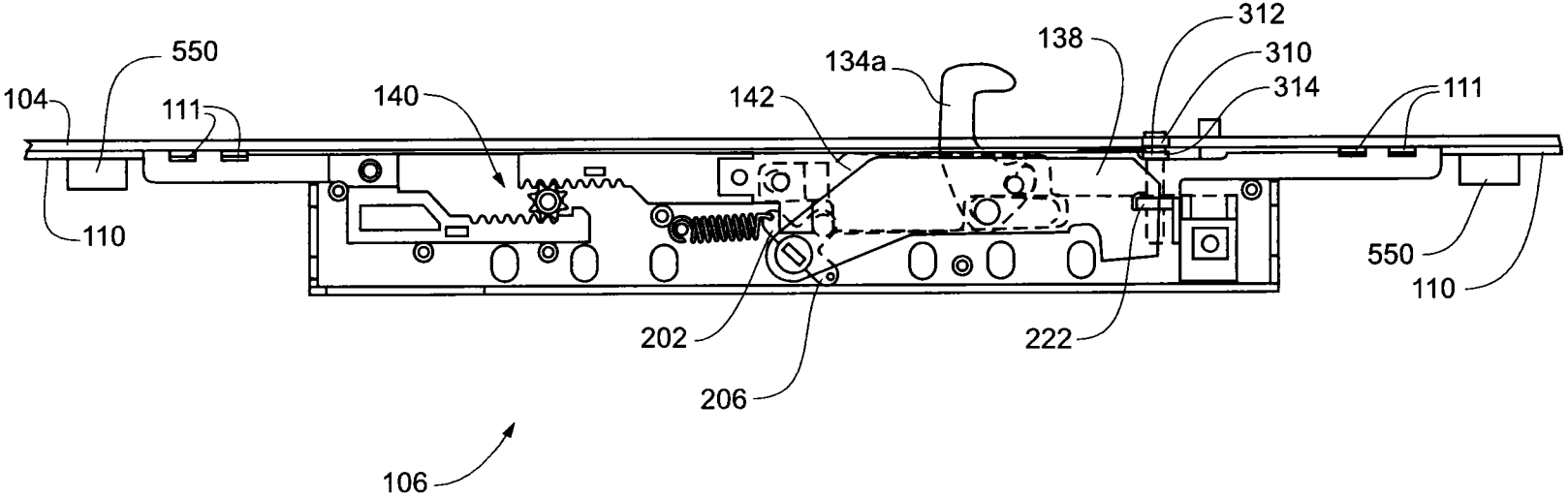
FIG. 6 is a cross-sectional view depicting an active locking device for use with shoot bolts according to an embodiment, depicted in a locked position.
Figure 7:
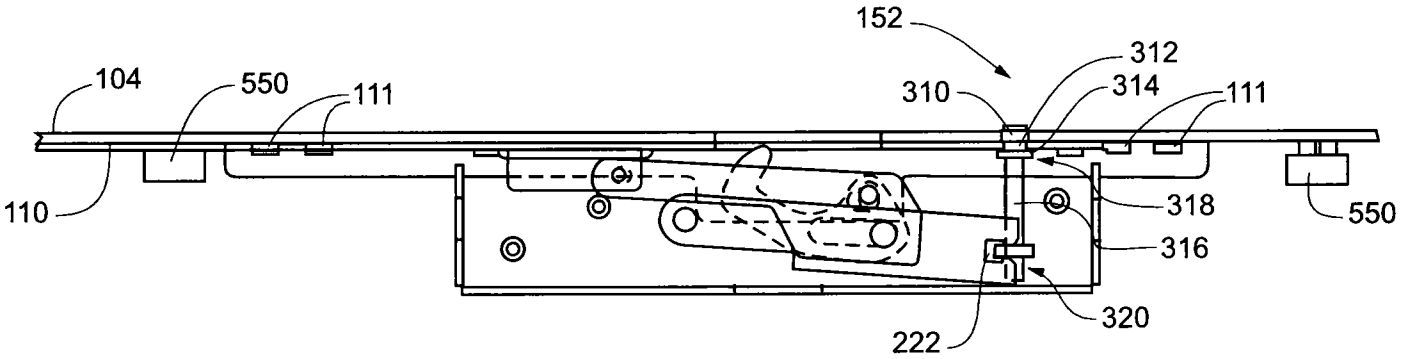
FIG. 7 is a cross-sectional view depicting a passive locking device for use with shoot bolts according to an embodiment, depicted in an unlocked position.
Figure 8:
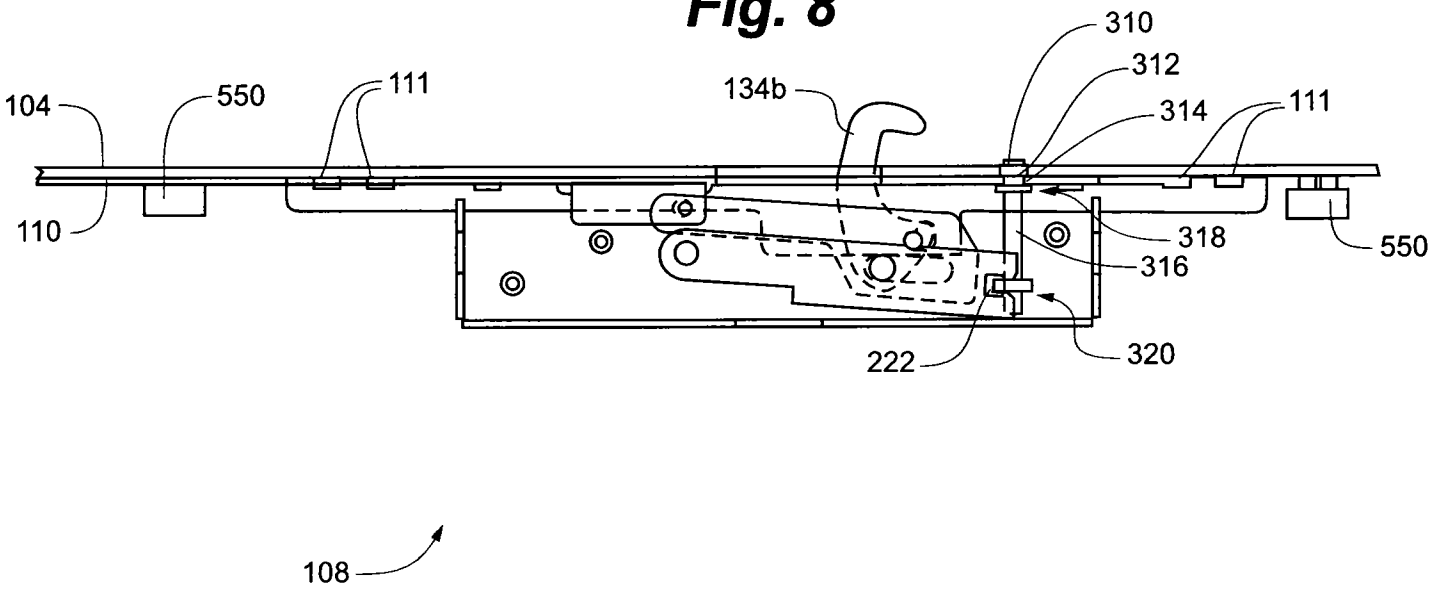
FIG. 8 is a cross-sectional view depicting a passive locking device for use with shoot bolts according to an embodiment, depicted in a locked position.
Figure 9:
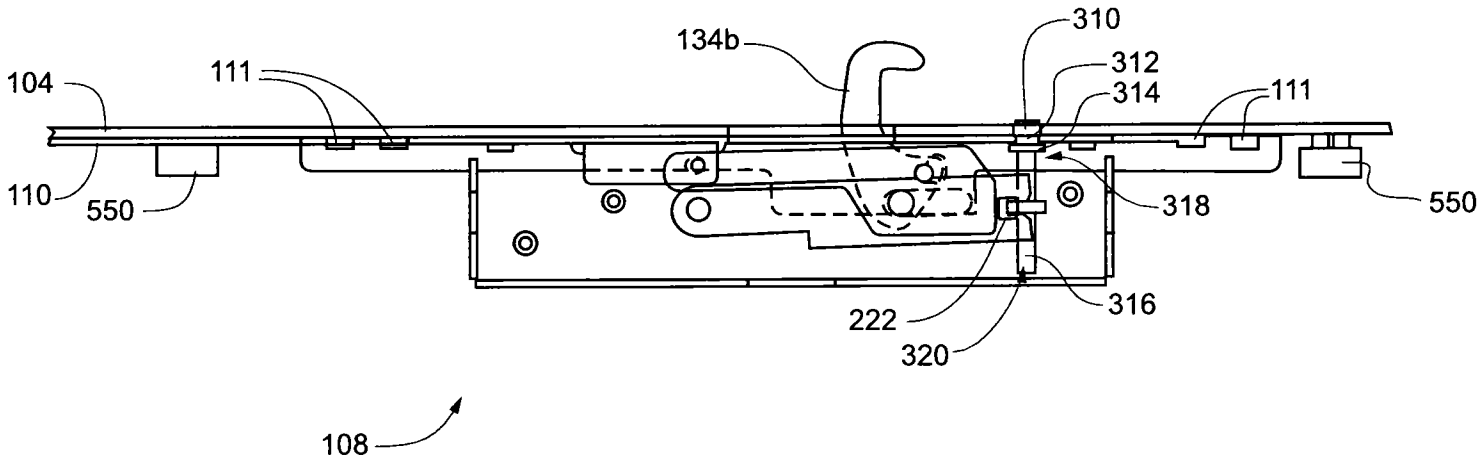
FIG. 9 is a cross-sectional view depicting a passive locking device for use with shoot bolts according to an embodiment, depicted in a locked position.
Figure 10:
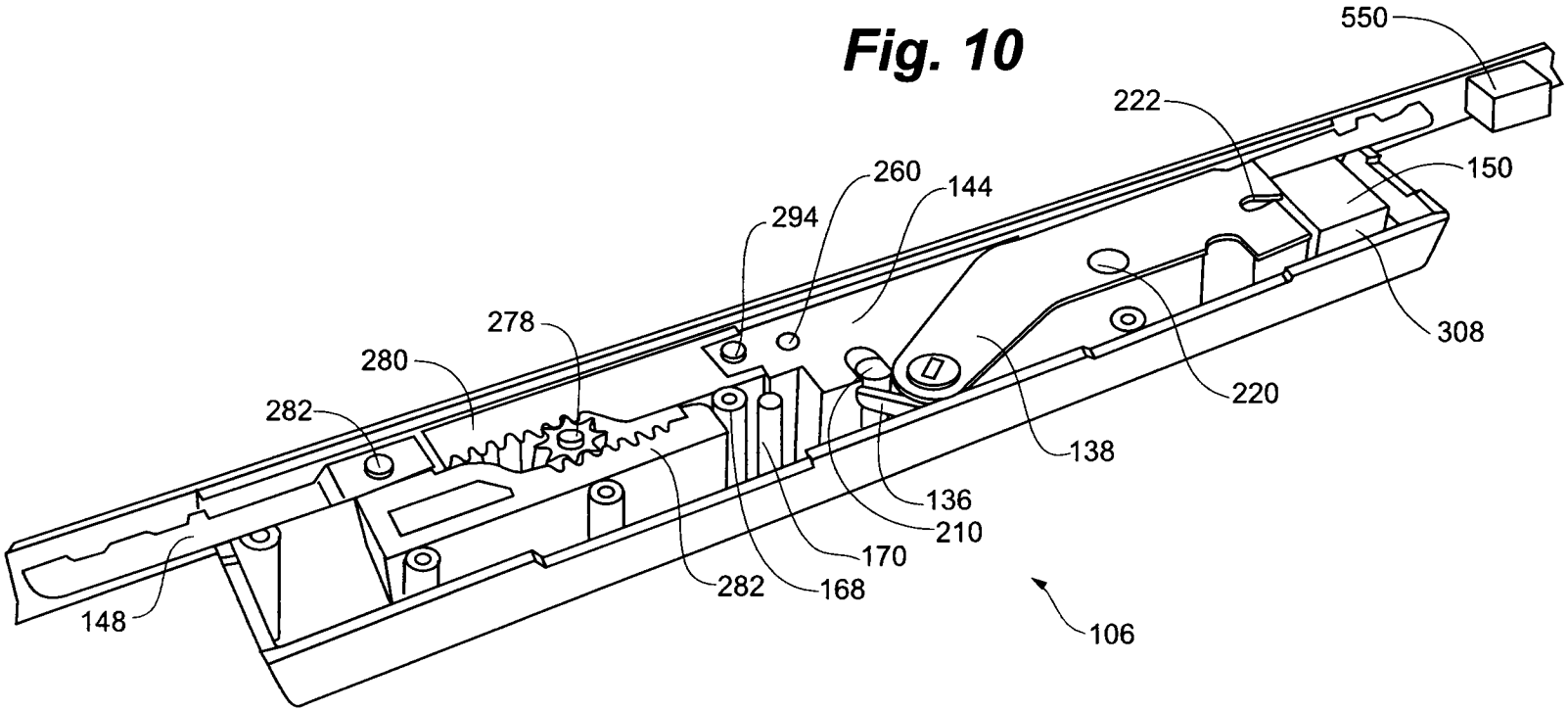
FIG. 10 is a perspective view depicting a partially disassembled active locking device for use with shoot bolts according to an embodiment, depicted in an unlocked position.
Figure 11:
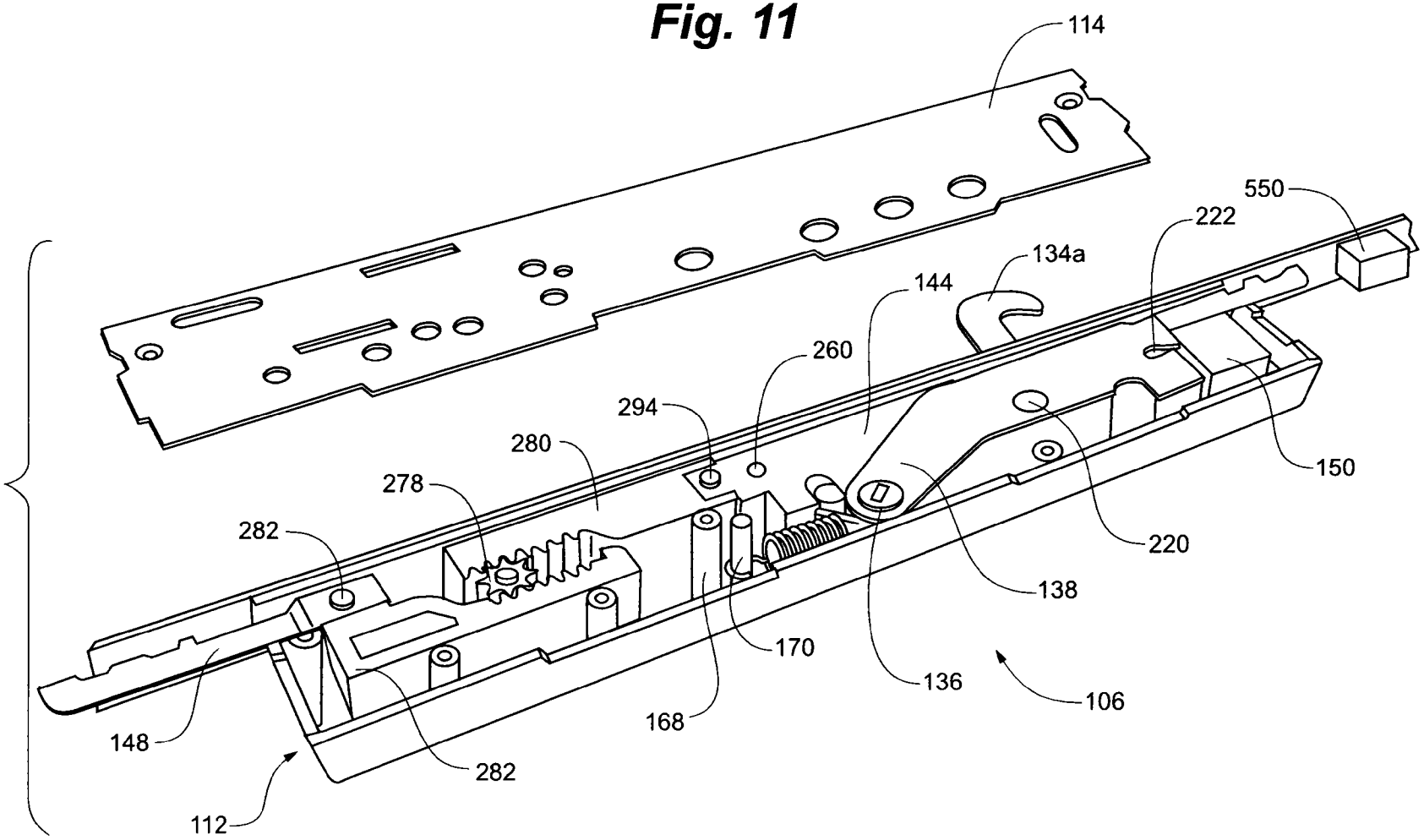
FIG. 11 is a perspective view depicting a partially disassembled active locking device for use with shoot bolts according to an embodiment, depicted in a locked position.

Anti-slam mechanism 150 generally includes anti-slam actuator 182, anti-slam body 302, anti-slam protrusion 304, and anti-slam spring hole 306. Anti-slam mechanism 150 generally ensures that the door is shut, or that anti-slam actuator 182 occupy a non-extended position, in order for adjustable latches 134 to be actuated into locked positions. Referring to FIG. 4, anti-slam body 302 fits into anti-slam recess 246 and thereby prevents lateral movement of active-lock actuator 144 when anti-slam body 302 occupies an extended position, such as, for example, when a sliding door is open. Referring to FIGS. 5-6, anti-slam body 302 is located below anti-slam recess 246 and thereby permit lateral movement of active-lock actuator 144 when anti-slam body 302 occupies an non-extended position, such as, for example, when a sliding door is closed. Anti-slam actuator hole 130 of faceplate 104 and anti-slam protrusion hole 178 of front wall 156 of active locking-device base 112 receive anti-slam actuator 182. Anti-slam protrusion slot 198 transversely receives anti-slam protrusion 304. Anti-slam spring hole 306 receives anti-slam spring 308.

Depth-adjustment mechanism 152 generally includes depth-adjustment screw 180*a* and threaded depth-adjustment bolt 222. Depth-adjustment mechanism 152 adjusts active-lock positioner 138 to control the depth of active latch 134*a* within active locking device 106. Small depth-adjustment screw hole 176 of front wall 156, active locking-device base 112 and large depth-adjustment screw hole 132*a* of faceplate 104 receive depth-adjustment screw 180*a*. Adjustment-bolt recess 218 of active-lock positioner 138 receives depth-adjustment bolt 222. Depth-adjustment screw 180*a* generally includes depth-adjustment screw head 310, depth-adjustment screw neck 312, depth-adjustment screw collar 314, and depth-adjustment screw body 316 having proximal end 318 and distal end 320. At least a portion of depth-adjustment screw 180*a* is threaded so as to receive threaded depth-adjustment bolt 222.

Upper passive locking device 108*a* and lower passive locking device 108*b* each include passive locking-device base 322, passive locking-device cover 324, passive latch 134*b*, passive-lock positioner 328, passive-lock drive plate 330, passive-lock actuator 332, depth-adjustment mechanism 152, and several connecting pins.

Passive locking-device base 322 generally includes main wall 334, front wall 336, back wall 338, top wall 340, and bottom wall 342. Main wall 334 has small positioner-pin hole 344*a*. Extending from main wall 334 toward passive locking-device cover 324 are fastening posts 346. Fastening posts 346 are attached to main wall 334 using a suitable connection method, including, for example, welding, press-fit, and spin-fit techniques. Front wall 336 has attachment holes 348, passive-latch opening 350 and small depth adjustment screw hole 351. Attachment holes 348 of passive-locking device base 322 are registered with attachment holes 128 of faceplate 104 so that fastening members inserted through aligned attachment holes 128, 348 to secure passive locking-device base 322 to faceplate 104. In addition, passive-latch opening 350 is generally aligned with lock channel 124 of faceplate 104 so as to allow passive latch 134*b* to freely pivot between locked and unlocked positions.

Passive locking-device cover 324 generally includes cover plate 352 defining a plurality of apertures, including positioner-pin hole 344*b* and cover-screw holes 356. Cover plate 352 has a shape so as to conformingly fit over front wall 336, back wall 338, top wall 340, and bottom wall 342 of passive locking-device base 322. Positioner-pin hole 344*b* of passive locking-device cover 324 is registered with positioner-pin 371 and with positioner-pin hole 344*a* of passive locking device base 322 and cover screw holes 356 are aligned with fastening posts 346 so as to enable passive latch 134*b* to freely pivot between locked and unlocked positions.

Passive latch 134*b* generally includes hook 358, drive-pin hole 360, and large pivot-pin hole 362. Hook 358 is shaped so to engage a keeper (not depicted) when passive latch 134*b* is in a locked position. Drive-pin hole 360 receives drive pin 522 and large pivot-pin hole 362 receives pivot pin 524.

Passive-lock positioner 328 generally includes positioner housing 364 generally defining positioner-pin holes 366, small pivot-pin holes 368, and adjustment-bolt recesses 370. Small pivot-pin holes 368 receive pivot pin 524. Adjustment-bolt recess 370 receives threaded depth-adjustment bolt 222. Large positioner-pin holes 366 receive positioner pin 371.

Passive-lock actuator 332 generally includes upper engagement region 372, middle region 374, and lower engagement region 376. Upper engagement region 372 and lower engagement region 376 define teeth 378 and grooves 380. Middle region 374 defines lock-channel cover 382 and actuator shelf 384 defining actuator-pin hole 386.

Passive-lock drive plate 330 generally includes drive-plate body 394 and drive-plate head 396. Drive-plate body 394 and drive-plate head 396 occupy the same plane. Drive plate body 394 defines pivot-pin slot 398 and drive-pin slot 400. Pivot-pin slot 398 transversely receives pivot pin 524 along a lateral axis. Drive-pin slot 400 transversely receives drive pin 522 along longitudinal and lateral axes. Drive-plate head 396 defines actuator-pin hole 402. Actuator-pin hole 402 receives actuator rivet 526.

Depth-adjustment mechanism 152 generally includes depth-adjustment screw 180*b* and threaded depth-adjustment bolt 222. Depth-adjustment mechanism 152 adjusts passive-lock positioner 328 to control the depth of passive latch 134*b* within passive locking device 108. Small depth-adjustment screw hole 351 of front wall 336 of passive locking-device base 322 and large depth-adjustment screw hole 132*b* of faceplate 104 receive depth-adjustment screw 180*b*. Adjustment-bolt recess 370 of passive-lock positioner 328 receives threaded depth-adjustment bolt 222.

Anti-slam spring 308 situated between anti-slam body 150 and back wall 158 of active locking-device base 112 biases anti-slam body 150, causing anti-slam actuator 182 to extend through anti-slam actuator holes 130, 178 of front wall 156 of active locking-device base 112 and faceplate 104. If an opposing force is not applied to anti-slam actuator 182, anti-slam actuator 182 remains in an extended position. Anti-slam body 150 can, however, be pushed toward back wall 158 of active locking-device base 112 to enable lever 504 to actuate active locking device 104. For example, by closing a sliding door against a door jamb, the force exerted against the sliding door causes anti-slam body 150 to compress anti-slam spring 308 and move toward back wall 158. When front surface of anti-slam body 150 is pushed past back edge of anti-slam recess 246, active-lock actuator 144 can be freely extended toward bottom end 122 of faceplate 104, as depicted in FIGS. 5-6.

In the unlocked position, crank member 136 is oriented so that top crank arm 202 is situated against or near back wall 158 of active locking-device base 112, as depicted in FIG. 4. Depending upon how lever 504 is disposed to actuator pin 502, raising or lowering distal end 510 of lever 504 rotates crank member 136 so that bottom crank arm 206 becomes situated against or near back wall 158 of active locking-device base 112. As crank member 136 rotates around axis A-A, middle crank arm 204 is also caused to rotate, moving from an upward orientation to a downward orientation, as depicted in FIGS. 4-5. As middle crank arm 204 rotates, crank-arm protrusion 210 moves away from top wall 160 and toward bottom wall 162 of active locking-device base 112. Crank-arm protrusion 210, which is situated within crank-protrusion recess 236 of active-lock actuator 144, can thereby cause active-lock actuator 144 to move toward bottom end 122 of faceplate 104. Crank-protrusion recess 236 is generally elongated so as to accommodate the lateral displacement of crank-arm protrusion 210 as crank-arm protrusion 210 moves longitudinally toward bottom wall 162. The longitudinal displacement of active-lock actuator 144 is generally defined by an arc traversed by crank-arm protrusion 210, which is defined by the length of middle crank arm 204.

Longitudinal displacement of active-lock actuator 144 directly affects the motion of three additional components. Active-lock actuator 144 generally longitudinally displaces active-lock drive plate 142 and front gear drive 280 toward bottom wall 162 and lower linking member 110*b* toward bottom end 122 of faceplate 104. Since the purpose of lower linking member 110*b* is to actuate lower passive locking device 108*b*, additional description of lower linking member 110*b* will follow in connection with description of lower passive-locking device 108*b*.

Figure 3:
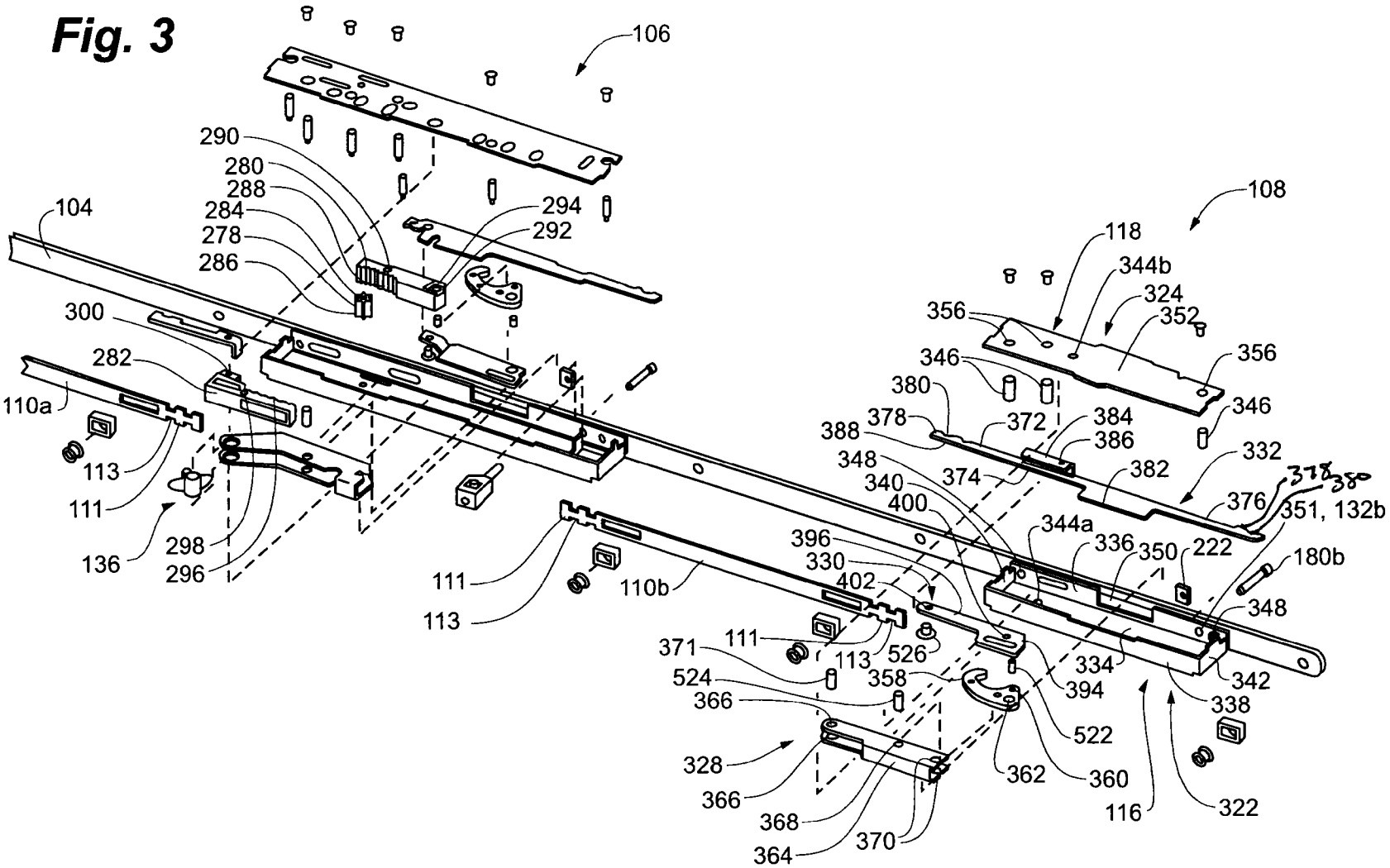
FIG. 3 is an exploded perspective view depicting an active locking device and a lower passive locking device for use with shoot bolts according to an embodiment.

Active-lock actuator 144 is operably connected to active-lock drive plate 142 by actuator rivet 260. Actuator rivet 260 is fixedly secured through large actuator-pin hole 258 in drive-plate head 250 of active-lock drive plate 142 and small actuator-pin hole 234 in active-lock actuator 144. As active-lock actuator 144 is longitudinally displaced, active-lock drive plate 142 is generally longitudinally displaced by a similar distance and in a similar direction. The direction of movement of active-lock drive plate 142 is maintained by pivot pin 220. Pivot pin 220 is fixedly secured through small pivot-pin holes 216 of active-lock positioner 138, rotatably secured through large pivot-pin hole 266 of active latch 134*a*, and transversely secured in pivot-pin slot 252 of active-lock drive plate 142. As depicted in FIG. 3, active-lock drive plate 142 is secured beneath active latch 134*a* within active-lock positioner 138. Pivot-pin slot 252 in drive-plate body 248 of active-lock drive plate 142 enables active-lock drive plate 142 to longitudinally slide about pivot pin 220.

Displacement of active-lock drive plate 142 toward bottom wall 162 exerts force upon drive pin 256. As depicted in FIG. 3, drive pin 256 is rotatably secured through drive-pin hole 264 of active latch 134*a* and transversely secured through drive-pin slot 254. The force exerted upon drive pin 256 causes active latch 134*a* to rotate about pivot pin 220 and causes drive pin 256 to be displaced within drive-pin slot 254 of active-lock drive plate 142. The shape of pivot-pin slot 252 generally permits drive-pin slot 254 to be displaced so as to accommodate the arc-shaped displacement of drive pin 256 created by the rotation of active latch 134*a* about pivot pin 220. The interaction of the arc-shape of drive pin slot 254, drive pin 256, and pivot pin 220 prevents latch 134*a* from backdriving. As active latch 134*a* rotates about pivot pin 220, hook 262 moves through active-latch opening 179 in active locking-device base 112 and latch channel 124 in faceplate 104 so as to occupy a locked position, as depicted in FIGS. 5-6.

Active-lock actuator 144 is also operably connected to front gear drive 280 by front-gear protrusion 294. As depicted in FIGS. 2-3, actuator extension 230 at upper engagement region 224 of active-lock actuator 144 is situated within front-gear recess 292 of front gear drive 280 so that front-gear protrusion 294 is fixedly secured through front-gear protrusion hole 232 of active-lock actuator 144. As active-lock actuator 144 is longitudinally displaced, front gear drive 280 is generally longitudinally displaced by a similar distance and in a similar direction. The direction of movement of front gear drive 280 is maintained by front-gear guides 290. Front-gear guides 290 are transversely secured through front-gear guide slots 164*a-b* of main wall 154 and plate cover 184. Front-gear guide slots 164*a-b* allow front gear drive 280 to longitudinally slide toward or away from top wall 160 and bottom wall 162.

Displacement of active-lock actuator 144 toward bottom wall 162 exerts a force upon front gear drive 280 that causes front gear drive 280 to be displaced toward bottom wall 162. Displacement of front gear drive 280 causes gears 288 of front gear drive 280 to engage gears 286 of cog 278. Cog 278 is rotatably secured in place by cog protrusions 284. Cog protrusions 284 are rotatably secured in cog-protrusion holes 166*a-b* of main wall 154 and cover plate 184.

Gears 286 of cog 278 also engage gears 296 of back gear drive 298. As the displacement of front gear drive 280 causes cog 278 to rotate, the rotation of cog 278 displaces back gear drive 282 in a direction opposite the direction of displacement of front gear drive 280, or toward top wall 160 of active locking-device base 112. To ensure that lower linking member 110*b* and upper linking member 110*a* are displaced by a substantially similar amount, the gear ratio between gears 288 of front gear drive 280 and gears 286 of cog 278 and the gear ratio between gears 296 of back gear drive 282 and gears 286 of cog 278 are 1:1.

Back gear drive 282 is operably connected to upper linking-member engager 148 by back-gear protrusion 300. Back gear protrusion 300 is fixedly secured through back-gear protrusion hole 276 in lower region 270 of upper linking-member engager 148. As back gear drive 282 is longitudinally displaced, upper linking-member engager 148 is generally longitudinally displaced by a similar distance and in a similar direction.

Upper linking-member engager 148 and lower-linking member engager 146 of active-lock actuator 144 generally operate in a similar manner to actuate passive latches 134*b*. Upper linking-member engager 148 has teeth 272 and grooves 274 matingly engaged to teeth 111 and grooves 113 of upper linking member 110*a*. As upper-linking member engager 148 is displaced toward top end 120 of faceplate 104, upper-linking member engager 148 can cause upper linking member 110*a* to be displaced by a similar amount and in a similar direction. Similarly, lower linking-member engager 146 has teeth 242 and grooves 244 matingly engaged to teeth 111 and grooves 113 of lower linking member 110*b*. As lower-linking member engager 146 is displaced toward lower end 122 of faceplate 104, lower-linking member engager 146 can cause upper linking member 110*a* to be displaced by a similar amount and in a similar direction. Referring to FIGS. 2-3, upper linking member 110*a* and lower linking member 110*b* are generally transversely secured to faceplate 104 by retainers 550 and retainer rivets 552. Retainer rivets 552 are fixedly secured through retainer-screw holes 554 of retainer 550 and mounting holes 128 of faceplate 104. Upper and lower linking members 110*a-b* can be slidably disposed intermediate faceplate 104 and retainer 550 such that retainer rivet 552 is situated within link-member channel 556. Upper and lower linking members 110*a-b* can thereby be secured proximal to faceplate 104 so as to slide about retainer rivet 552.

The description that follows primarily describes the operation of lower passive locking device 108*b*. It will be appreciated, however, that the direction of operation of upper passive locking device 108*a* is similar. Referring to FIGS. 2-3, lower linking member 110*b* is operably connected to upper engagement region 372 of passive-lock actuator 332. Lower linking member 110*b* has teeth 111 and grooves 113 matingly engaged to teeth 378 and grooves 380 of passive-lock actuator 332. As lower linking member 110*b* is displaced toward bottom end 122 of faceplate 104, lower linking member 110*b* can cause passive-lock actuator 332 to be displaced by a similar amount and in a similar direction.

Passive-lock actuator 332 is operably coupled to passive-lock drive plate 330 by actuator rivet 526. Actuator rivet 526 is fixedly secured through large actuator-pin hole 402 in drive-plate head 396 of passive-lock drive plate 330 and small actuator-pin hole 386 in actuator shelf 384. As passive-lock actuator 332 is longitudinally displaced, passive-lock drive plate 330 is generally longitudinally displaced by a similar distance and in a similar direction. The direction and movement of passive-lock drive plate 330 is defined by pivot pin 524. Pivot pin 524 is fixedly secured through small pivot-pin holes 368 of passive-lock positioner 328, rotatably secured through large pivot-pin hole 362 of passive-latch 134*b*, and transversely secured in pivot-pin slot 398 of passive-lock drive plate 330. As depicted in FIG. 3, passive-lock drive plate 330 is secured above passive latch 134*b* within passive-lock positioner 328. Pivot-pin slot 398 in body drive-plate 394 of passive-lock drive plate 330 allow passive-lock drive plate 330 to longitudinally slide about pivot pin 524.

Displacement of passive-lock drive plate 330 toward bottom wall 342 of passive locking-device base 322 exerts force upon drive pin 522. As depicted in FIG. 3, drive pin 522 is rotatably secured through drive-pin hole 360 of passive latch 134*b* and transversely secured through drive-pin slot 400. The force exerted upon drive pin 256 causes passive latch 134*b* to rotate about pivot pin 524 and cause drive pin 522 to be displaced within drive-pin slot 400 of passive-lock drive plate 330. The shape of pivot-pin slot 400 generally permits drive-pin 522 to be displaced as to accommodate the arc-shaped displacement of drive pin 522 created by the rotation of passive latch 134*b* about pivot pin 524. As passive latch 134*b* rotates pivot pin 524, hook 358 moves through passive latch opening 350 in active latch device-base 322 and latch channel 124 in faceplate 104 so as to occupy a locked position, as depicted in FIG. 5-6.

According to an embodiment of the invention, projections 92 of drive bar 84 of each linking adapter 80 engage in grooves 380 of lower engagement region 376 of passive-lock actuator 332 of each of passive lock assemblies 108*a*, 108*b*, as depicted in FIGS. 1*b*-1*d*, to link drive bar 84 to passive lock assemblies 108*a*, 108, and active locking device 106. Hence, couplers 68 of linking adapters 80 are translated away from passive locking assemblies 108*a*, 108*b*, when active locking device 106 is actuated to latch the door, and are translated toward passive locking assemblies 108*a*, 108*b*, when active locking device 106 is actuated to unlatch the door.

Shoot bolt assemblies 30 can be directly coupled to the drive bars 84 to each of linking adapters 80 by engaging coupler 68 with the serrations of serrated portion 46 of drive bar 36. Alternatively, extension bar assembly 60 can be interposed between either or both of linking adapters 80 and shoot bolt assemblies 30 to extend the length of the assembly to accommodate taller doors. In this case, coupler 68 of linking adaptors 80 are engaged with serrated coupling portion 72 of extension bar assembly 60 while coupler 68 of extension bar assembly 60 is engaged with serrated portion 46 of drive bar 36.

As depicted in FIG. 1*a*, a sliding door assembly 600 according to an embodiment of the invention is disposed in an opening defined in a wall 602 of a structure and generally includes door panels 604, 605, slidably disposed in tracks 606. Lock assembly 100, shoot bolts 30, and if used, extension bar assembly 60, are disposed in a mortise defined in a vertical side surface 608 of door panel 604.

Figures 3A, 3B:
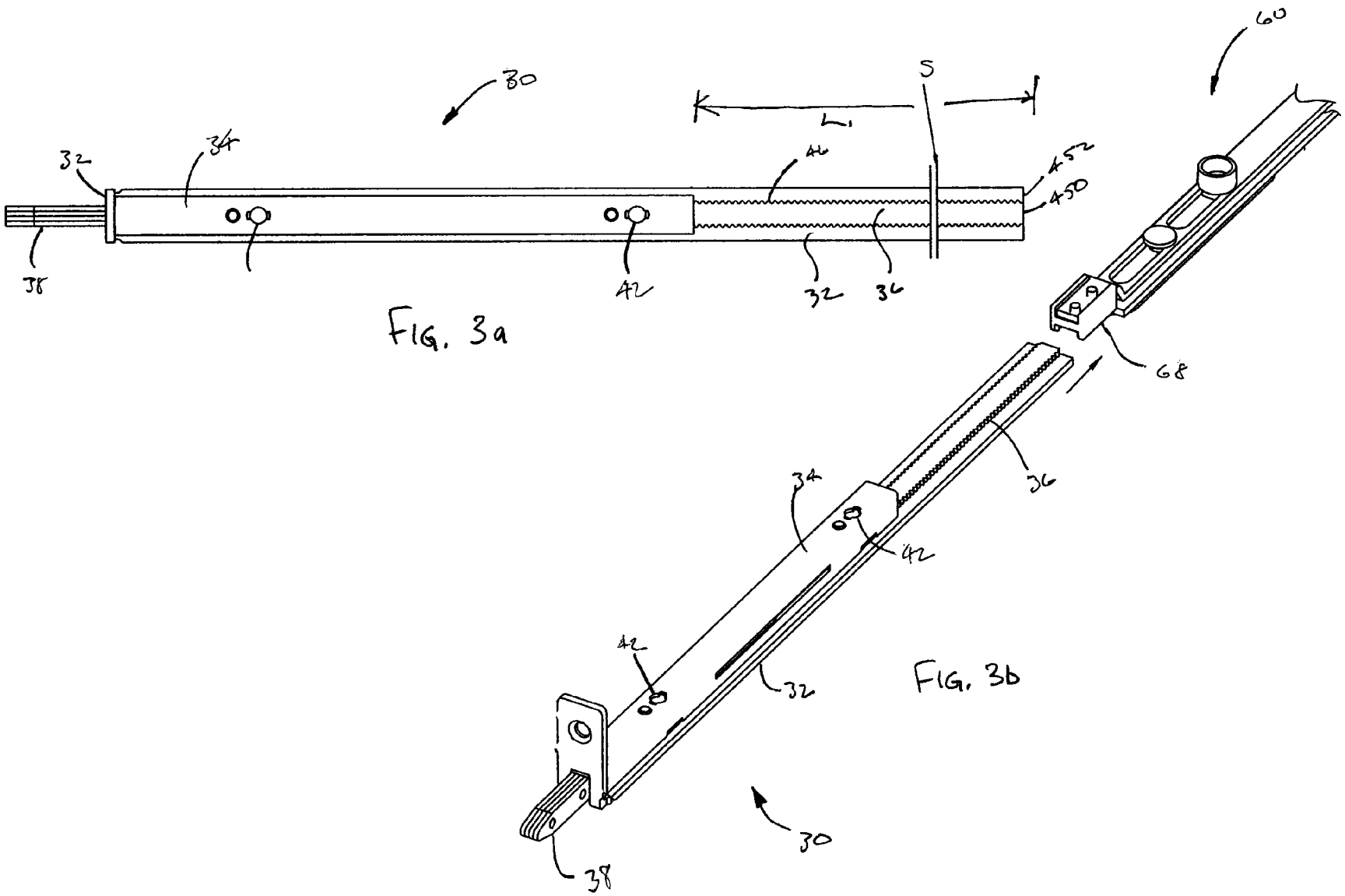
FIG. 3*a* is a rear plan view of a shoot bolt assembly of FIG. 2*a;*
FIG. 3*b* is a rear/top isometric view of the shoot bolt assembly of FIG. 3*a* with an extension bar assembly.

According to another aspect of the invention, as depicted in FIG. 3*a*, shoot bolt assemblies 30 can also be trimmed in length to accommodate various door heights. With end 450 of drive bar 36 registered with end 452 of face plate 32, drive bar 36 and face plate 32 can be cut off at any position S along the length L1 of drive bar 36. Advantageously, since serrations are provided along the full length L1 of drive bar 36, coupler 68 of linking adaptor 80 or extension assembly 60 can be subsequently engaged with the remaining length of drive bar 36 after trimming to the desired length.

Figures 5A, 5B, 5C, 5D, 5E:
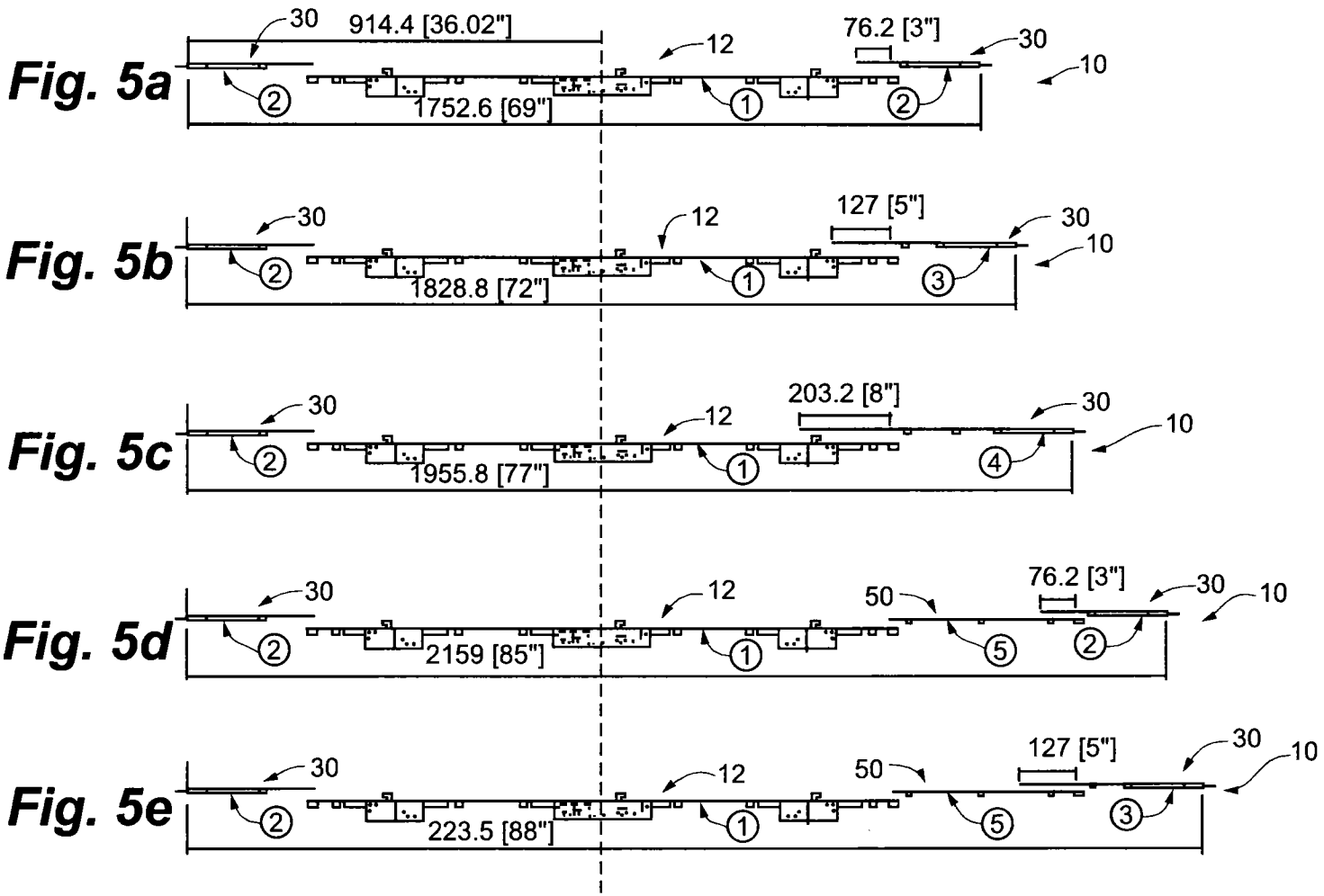
FIG. 5*a* is a side elevation view of a multipoint sliding door lock assembly with three hooks and linking adaptor assemblies linking shoot bolts at each end, the assembly adapted for a standard 69 inch height door panel.
FIG. 5*b* is a side elevation view of a multipoint sliding door lock assembly with three hooks and linking adaptor assemblies linking shoot bolts at each end, the assembly adapted for a standard 72 inch height door panel.
FIG. 5*c* is a side elevation view of a multipoint sliding door lock assembly with three hooks and linking adaptor assemblies linking shoot bolts at each end, the assembly adapted for a standard 77 inch height door panel.
FIG. 5*d* is a side elevation view of a multipoint sliding door lock assembly with three hooks and linking adaptor assemblies linking a shoot bolt at one end and an extension bar and shoot bolt at the opposite end, the assembly adapted for a standard 85 inch height door panel.
FIG. 5*e* is a side elevation view of a multipoint sliding door lock assembly with three hooks and linking adaptor assemblies linking a shoot bolt at one end and an extension bar and shoot bolt at the opposite end, the assembly adapted for a standard 88 inch height door panel.
Figures 5F, 5G, 5H, 5I, 5J:
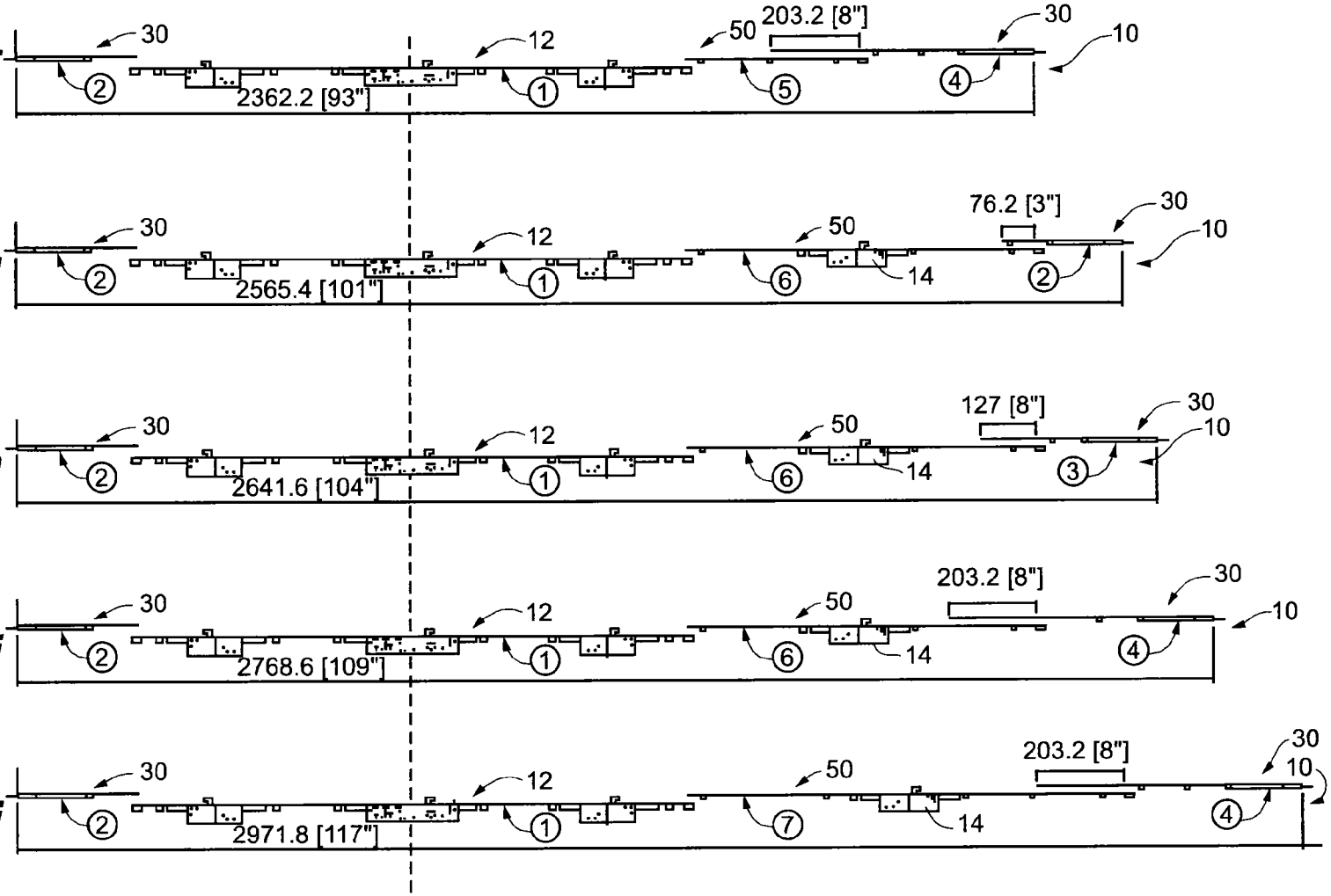
FIG. 5*f* is a side elevation view of a multipoint sliding door lock assembly with three hooks and linking adaptor assemblies linking a shoot bolt at one end and an extension bar and shoot bolt at the opposite end, the assembly adapted for a standard 93 inch height door panel.
FIG. 5*g* is a side elevation view of a multipoint sliding door lock assembly with three hooks and linking adaptor assemblies linking a shoot bolt at one end and an extension bar with incorporated additional passive locking assembly and shoot bolt at the opposite end, the assembly adapted for a standard 101 inch height door panel.
FIG. 5*h* is a side elevation view of a multipoint sliding door lock assembly with three hooks and linking adaptor assemblies linking a shoot bolt at one end and an extension bar with incorporated additional passive locking assembly and shoot bolt at the opposite end, the assembly adapted for a standard 104 inch height door panel.
FIG. 5*i* is a side elevation view of a multipoint sliding door lock assembly with three hooks and linking adaptor assemblies linking a shoot bolt at one end and an extension bar with incorporated additional passive locking assembly and shoot bolt at the opposite end, the assembly adapted for a standard 109 inch height door panel.
FIG. 5*j* is a side elevation view of a multipoint sliding door lock assembly with three hooks and linking adaptor assemblies linking a shoot bolt at one end and an extension bar with incorporated additional passive locking assembly and shoot bolt at the opposite end, the assembly adapted for a standard 117 inch height door panel.
Figure 5K:
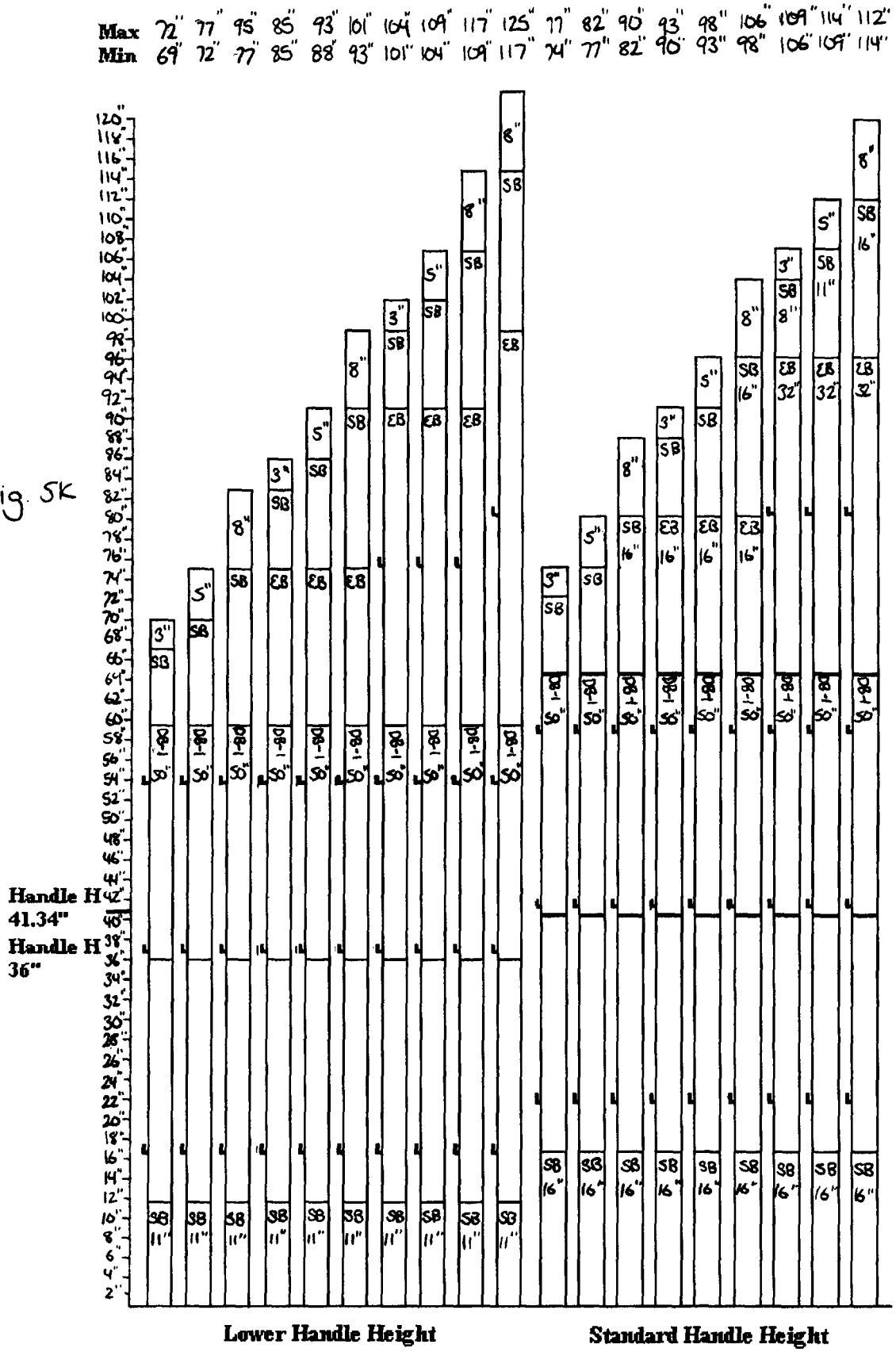
FIG. 5*k* is a table showing some various potential combinations of the elements of the present disclosure to achieve a variety of desired door height configurations.

Referring to FIGS. 5*a*-5*j* and the chart of FIG. 5*k*, it will be appreciated that by using various combinations of shoot bolt assemblies 30, extension bar assemblies 60, and additional passive lock assemblies 108, and by trimming shoot bolt assemblies 30 to length, a lock assembly according to the present invention can be made to accommodate a door panel 604 of virtually any height, while still enabling shoot bolts at the top and bottom of the door. In particular, the assembly can be adapted to any of various standard door heights by using standard components and without resorting to any custom-made components.

For example, as depicted in FIGS. 5*a*-5*c*, shoot bolt assemblies 30 can be attached directly to linking adaptors 80 at each end of lock assembly 100, and the upper shoot bolt assembly 30 trimmed to an appropriate length, to accommodate standard door heights of 69 inches, 72 inches, and 77 inches, or any intermediate non-standard door height. As depicted in FIGS. 5*d*-5*f*, an extension bar assembly 60 can be interposed between the upper linking adaptor 80 and the upper shoot bolt 30 to accommodate standard door heights of 85 inches, 88 inches, and 93 inches, or any intermediate non-standard door height, with appropriate trimming of the upper shoot bolt 30. Still further, as depicted in FIGS. 5*g*-5*h*, an additional passive lock 108 can be incorporated into extension bar assembly 60 to accommodate standard door heights of 101 inches, 104 inches, 109 inches, and 117 inches, or any intermediate non-standard door height, with appropriate trimming of upper shoot bolt 30. FIG. 5*k* is a chart depicting various combinations of components for various standard door heights assuming standard actuator handle heights of 36 inches and 41.344 inches.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, according to the spirit of the invention. Likewise, the various features described above should all be regarded as example embodiments, rather than limitations to the scope or spirit of the invention. Therefore, the above is not contemplated to limit the scope of the present invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A multi-point lock assembly adapted for accommodating a plurality of door panel height dimensions, the assembly comprising:

an active lock actuator assembly;

a passive lock assembly operably coupled to the active lock actuator assembly; and a shoot bolt assembly operably coupled to the passive lock assembly, wherein the shoot bolt assembly comprises a face plate, a flat drive bar having a proximal end with a serrated portion slidably disposed on the face plate, a bolt assembly slidably disposed on the face plate, and a gear drive assembly including a fixed rack, a driven rack, and at least one pinion engaged with the fixed rack and the driven rack operably coupling the flat drive bar and the bolt assembly, and wherein a length dimension of the shoot bolt assembly is alterable to accommodate each of the plurality of door panel height dimensions by trimming off a portion of the shoot bolt assembly;

a linking adaptor assembly interposed between the passive lock assembly and the shoot bolt assembly wherein the linking adaptor assembly comprises a drive bar with a connector, and wherein the connector of the linking adaptor assembly is selectively engagable at a plurality of positions on the serrated portion of the shoot bolt assembly drive bar.

2. The multi-point lock assembly of claim 1, wherein the shoot bolt assembly comprises a housing fixed to the face plate, and wherein the fixed rack is fixedly attached to the housing or the face plate.

3. The multi-point lock assembly of claim 1, wherein the at least one pinion is carried on the drive bar of the shoot bolt assembly, and wherein the drive rack is carried on the bolt assembly.

4. The multi-point lock assembly of claim 1, further comprising an extension bar assembly interposed between and operably coupling the passive lock actuator assembly and the shoot bolt assembly.

5. A method of installing a multi-point lock assembly in a door panel, the method comprising:

disposing an active lock actuator assembly and a passive lock actuator assembly in a mortise defined in an edge of the door panel, the active lock actuator assembly operably coupled with the passive lock actuator assembly;

trimming a length of a shoot bolt assembly comprising registering an end of a drive bar of the shoot bolt assembly with an end of a face plate of the shoot bolt assembly, and cutting the drive bar of the shoot bolt assembly and the face plate of the shoot bolt assembly together at the same location;

operably coupling the trimmed shoot bolt assembly with the passive lock actuator assembly and disposing the shoot bolt assembly in the mortise.

6. The method of claim 5, further comprising interposing an extension bar assembly between the passive lock assembly and the shoot bolt assembly and operably coupling the extension bar assembly with the passive lock assembly and the shoot bolt assembly.

7. The method of claim 5, further comprising interposing a linking adaptor between the passive lock assembly and the shoot bolt assembly, and operably coupling the linking adaptor with the passive lock assembly and the shoot bolt assembly.

8. A multi-point lock assembly adapted for accommodating a plurality of door panel height dimensions, the assembly comprising:

an active lock actuator assembly;

a passive lock assembly operably coupled to the active lock actuator assembly; and a shoot bolt assembly operably coupled to the passive lock assembly, wherein the shoot bolt assembly comprises a face plate, a flat drive bar slidably disposed on the face plate, a bolt slidably disposed on the face plate, and a gear drive assembly including a fixed rack, a driven rack, and at least one pinion engaged with the fixed rack and the driven rack operably coupling the drive bar and the bolt, the flat drive bar having a serrated portion defined on a proximal end thereof, and wherein a length dimension of the shoot bolt assembly is alterable to accommodate each of the plurality of door panel height dimensions by removing a portion of the drive bar and the face plate;

a linking adaptor assembly interposed between the passive lock assembly and the shoot bolt assembly wherein the linking adaptor assembly comprises a drive bar and a connector, and wherein the connector of the linking adaptor assembly is selectively engagable with the serrated portion of the flat drive bar at a plurality of positions on the serrated portion.

* * * * *